US010124977B2

(12) United States Patent
Moriya et al.

(10) Patent No.: US 10,124,977 B2
(45) Date of Patent: Nov. 13, 2018

(54) SHEET STACKING APPARATUS AND IMAGE FORMING SYSTEM

(71) Applicant: CANON FINETECH NISCA INC., Misato-shi (JP)

(72) Inventors: Shintaro Moriya, Minamikoma-gun (JP); Kazuhiko Watanabe, Minamikoma-gun (JP); Hiroshi Amano, Minamikoma-gun (JP); Seiji Ono, Minamikoma-gun (JP); Ichiro Yoda, Minamikoma-gun (JP); Masao Ueno, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 145 days.

(21) Appl. No.: 15/359,755

(22) Filed: Nov. 23, 2016

(65) Prior Publication Data

US 2017/0240374 A1 Aug. 24, 2017

(30) Foreign Application Priority Data

Feb. 19, 2016 (JP) ..... 2016-029825
Nov. 8, 2016 (JP) ..... 2016-217961

(51) Int. Cl.
*B65H 31/34* (2006.01)
*B65H 29/12* (2006.01)
(Continued)

(52) U.S. Cl.
CPC ..... *B65H 31/34* (2013.01); *B65H 29/12* (2013.01); *B65H 31/02* (2013.01);
(Continued)

(58) Field of Classification Search
CPC .... B65H 31/34; B65H 29/12; B65H 31/3027; B65H 31/3036; B65H 31/3081;
(Continued)

(56) References Cited

U.S. PATENT DOCUMENTS 5,139,254 A * 8/1992 Yamashita ..... B65H 31/18 271/213
6,241,234 B1 6/2001 Saitoh et al.
(Continued)

FOREIGN PATENT DOCUMENTS

JP H10-194569 A 7/1998

*Primary Examiner* — Patrick H Mackey
(74) *Attorney, Agent, or Firm* — Fitzpatrick, Cella, Harper & Scinto

(57) ABSTRACT

A sheet stacking apparatus including a control portion is configured to execute: a first mode in which the control portion causes a bundle forming portion to form a bundle of sheets including a sheet supported by a first placement portion and a sheet placed on a second placement portion; and a second mode in which a downstream end portion of a bundle of sheets formed in the second mode is positioned upstream of a downstream end portion of a bundle of sheets to be formed in the first mode, and wherein the control portion sets a maximum number of sheets constituting a bundle of sheets which the control portion causes the bundle forming portion to form in the second mode to be smaller than a maximum number of sheets constituting a bundle of sheets which the control portion causes the bundle forming portion to form in the first mode.

8 Claims, 17 Drawing Sheets

(51) Int. Cl.

| | |
|---|---|
| ***B65H 31/30*** | (2006.01) |
| ***G03G 15/00*** | (2006.01) |
| ***B65H 31/02*** | (2006.01) |
| ***B65H 31/36*** | (2006.01) |
| ***B65H 31/38*** | (2006.01) |
| ***B65H 33/08*** | (2006.01) |
| ***B65H 43/06*** | (2006.01) |

(52) U.S. Cl.
CPC ..... *B65H 31/3027* (2013.01); *B65H 31/3036* (2013.01); *B65H 31/3081* (2013.01); *B65H 31/36* (2013.01); *B65H 31/38* (2013.01); *B65H 33/08* (2013.01); *B65H 43/06* (2013.01); *G03G 15/6541* (2013.01); *G03G 15/6544* (2013.01); *B65H 2301/4212* (2013.01); *B65H 2301/4213* (2013.01); *B65H 2301/42192* (2013.01); *B65H 2511/10* (2013.01); *B65H 2801/27* (2013.01); *G03G 2215/00827* (2013.01)

(58) Field of Classification Search
CPC ..... B65H 31/36; B65H 31/38; B65H 33/08; B65H 43/06; G03G 15/6541
See application file for complete search history.

(56) References Cited

U.S. PATENT DOCUMENTS

| | | | | |
|---|---|---|---|---|
| 6,264,189 | B1 * | 7/2001 | Kawata | B65H 29/51 271/176 |
| 6,786,483 | B2 * | 9/2004 | Nishimura | B65H 7/02 271/176 |
| 7,165,764 | B2 * | 1/2007 | Nakamura | B42C 1/12 270/58.08 |
| 8,332,065 | B2 * | 12/2012 | Kurakata | B65H 31/10 270/58.09 |
| 8,876,106 | B2 * | 11/2014 | Koyama | B65H 31/20 271/215 |
| 2002/0190456 | A1 * | 12/2002 | Miyake | B65H 29/51 270/58.08 |
| 2017/0036882 | A1 * | 2/2017 | Yokoya | B65H 43/06 |

* cited by examiner

SHEET STACKING APPARATUS AND IMAGE FORMING SYSTEM

BACKGROUND OF THE INVENTION

Field of the Invention

The present invention relates to a sheet stacking apparatus configured to form a plurality of sheets conveyed from an image forming apparatus into a bundle of sheets and move the bundle of sheets, and to an image forming system including the sheet stacking apparatus.

Description of the Related Art

Hitherto, there have been provided image forming systems in which image forming apparatus such as a copying machine, a printer, a facsimile machine, and a multifunction peripheral thereof are connected to post-processing apparatus configured to perform various types of post-processing including sorting, aligning, binding, folding, and perforating on sheets discharged from the image forming apparatus. Those post-processing apparatus are each configured to stack sheets from the image forming apparatus on a processing tray, perform necessary post-processing, and then convey the sheets onto a stack tray.

There has been known a post-processing apparatus having a sorting function of sorting sheets, without binding the sheets, and then discharging and stacking the sheets onto one stack tray (U.S. Pat. No. 6,241,234). In U.S. Pat. No. 6,241,234, there is described a sheet processing apparatus having a configuration in which, when the number of sheets included in one bundle of sheets to be discharged in a sorting mode is equal to or larger than a predetermined number, the bundle of sheets is divided into groups each including a small number of sheets, which is at least two sheets, and discharged to the processing tray, and after that, the bundle of sheets stacked on the processing tray is discharged to a stack tray by a bundle discharge roller.

In the above-mentioned related-art apparatus, there has been a concern in that, when the bundle of sheets is moved from the processing tray to the stack tray in a state of a bundle, a leading edge of the bundle of sheets may be brought into abutment against an upper surface of sheets aligned and stacked in advance on the stack tray to cause displacement of the sheets on the stack tray by the effect of a force of moving the bundle of sheets, with the result that a stack alignment property of sheets may be degraded.

SUMMARY OF THE INVENTION

Thus, the present invention has been made in view of the above-mentioned problem of the related art, and an object of the present invention is to improve a stack alignment property of sheets in a sheet stacking apparatus configured to form a bundle of sheets, move the bundle of sheets in a predetermined direction, and place the bundle of sheets.

Another object of the present invention is to provide an image forming system having an excellent sheet stack alignment property through employment of the sheet stacking apparatus.

According to one embodiment of the present invention, there is provided a sheet stacking apparatus, comprising:

a first sheet placement portion on which a conveyed sheet is to be placed;

a sheet bundle forming portion configured to form, in a state in which the first sheet placement portion supports a sheet, a bundle of sheets including the sheet;

a sheet moving portion configured to move a bundle of sheets formed by the sheet bundle forming portion in a predetermined moving direction;

a second sheet placement portion on which a bundle of sheets moved by the sheet moving portion is to be placed; and a control portion, wherein the control portion is configured to execute:

a first mode in which the control portion causes the sheet bundle forming portion to form, in a state in which a sheet is supported by the first sheet placement portion and a sheet is placed on the second sheet placement portion, a bundle of sheets including the sheet; and a second mode in which, in a case where the control portion causes the sheet bundle forming portion to form, in a state in which a sheet is supported by the first sheet placement portion, a bundle of sheets including the sheet, a downstream end portion of the bundle of sheets in the moving direction is positioned upstream of a downstream end portion of a bundle of sheets to be formed in the first mode in the moving direction, and wherein the control portion is configured to set a maximum number of sheets constituting a bundle of sheets which the control portion causes the sheet bundle forming portion to form in the second mode to be smaller than a maximum number of sheets constituting a bundle of sheets which the control portion causes the sheet bundle forming portion to form in the first mode.

Further features of the present invention will become apparent from the following description of exemplary embodiments with reference to the attached drawings.

DESCRIPTION OF THE EMBODIMENTS

Now, with reference to the attached drawings, exemplary embodiments of the present invention will be described in detail. Note that, in the attached drawings, the same components are denoted by the same reference symbols throughout the specification.

Figure 1:
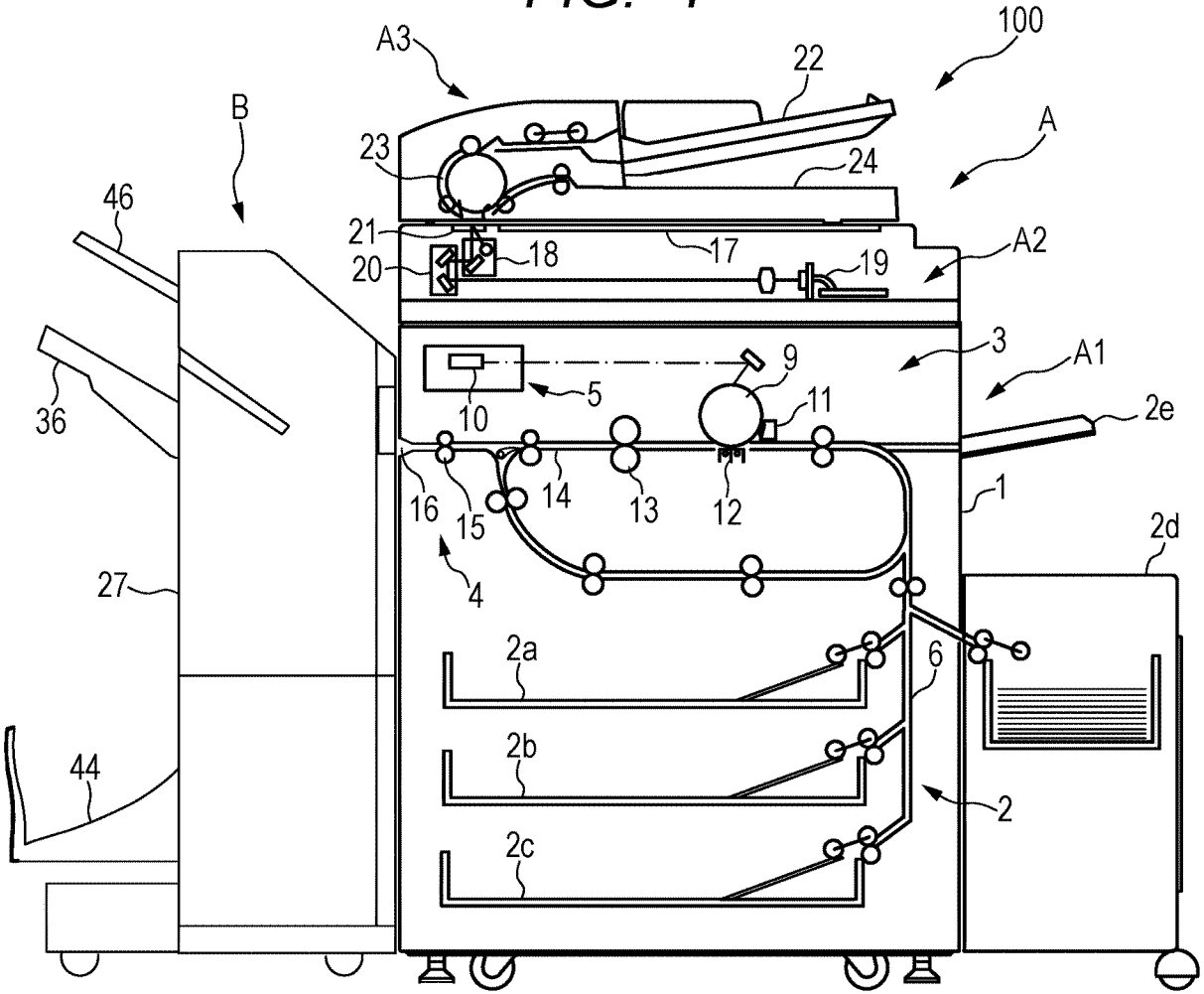
FIG. 1 is an explanatory view of the overall structure of an image forming system according to an embodiment of the present invention.

The overall structure of an image forming system including a sheet stacking apparatus of the present invention is schematically illustrated in FIG. 1. As illustrated in FIG. 1, an image forming system 100 includes an image forming apparatus A and a sheet post-processing apparatus B juxtaposed to the image forming apparatus A. The image forming apparatus A includes an image forming unit A1, a scanner unit A2, and a feeder unit A3. In a main body housing 1, the image forming unit A1 includes a sheet feeding portion 2, an image forming portion 3, a sheet discharge portion 4, and a data processing portion 5.

The sheet feeding portion 2 includes a plurality of cassette mechanisms 2*a*, 2*b*, and 2*c* configured to receive sheets of different sizes to be subjected to image formation, respectively, and sends out sheets having a size designated by a main body control portion 87 (FIG. 6) to a sheet feeding path 6. The cassette mechanisms 2*a*, 2*b*, and 2*c* are removably mounted in the sheet feeding portion 2, and each cassette mechanism includes a separating mechanism configured to separate sheets in the cassette mechanism one by one and a sheet feeding mechanism configured to send out the sheets. On the sheet feeding path 6, there are provided conveyance rollers configured to feed sheets, which are supplied from the respective cassette mechanisms 2*a*, 2*b*, and 2*c*, to downstream, and a registration roller pair. The registration roller pair is provided at an end of the sheet feeding path 6 and configured to correct skew feed of sheets and adjust a timing of conveying the sheets.

A large capacity cassette 2*d* and a manual feed tray 2*e* are connected to the sheet feeding path 6. The large capacity cassette 2*d* is an optional unit configured to receive sheets having a size which is consumed in large amounts. The manual feed tray 2*e* is configured to enable supply of special sheets, such as thick sheets, coated sheets, or film sheets, which are difficult to be separated and fed.

The image forming portion 3 is constructed by, for example, an electrostatic printing mechanism (electrophotographic printing method), and includes a photosensitive drum 9 to be rotated, and a light emitting unit 10 configured to emit an optical beam, a developing unit 11, and a cleaner (not shown), which are arranged around the photosensitive drum 9. The image forming portion 3 illustrated in FIG. 1 has a monochromatic printing mechanism. A latent image is optically formed on the photosensitive drum 9 by the light emitting unit 10, and the developing unit 11 causes toner as a developer to adhere on the latent image.

A sheet is fed from the sheet feeding path 6 to the image forming portion 3 by the registration roller pair at a timing of forming an image on the photosensitive drum 9, and the toner image is transferred onto the sheet by a transfer charger 12. The toner image is fixed on the sheet by fixing rollers 13 arranged on a sheet discharge path 14. On the sheet discharge path 14, there are arranged a sheet discharge roller 15 and a sheet discharge port 16 to convey the sheet having the image formed thereon to the sheet post-processing apparatus B described later.

The scanner unit A2 includes a platen 17 on which an original is to be placed, a carriage 18 configured to reciprocate along the platen 17, a photoelectric converter 19, and a reduction optical system 20 configured to guide light, which is radiated from the carriage 18 and reflected from the original placed on the platen 17, to the photoelectric converter 19. The photoelectric converter 19 is configured to photoelectrically convert optical output from the reduction optical system 20 to image data and to output the image data to the image forming portion 3 as an electric signal.

Further, the scanner unit A2 includes a running platen 21 configured to read an image on an original fed from the feeder unit A3. The feeder unit A3 includes a feeding tray 22, a feeding path 23 configured to guide the original fed from the feeding tray 22 to the running platen 21, and a discharge tray 24 configured to receive the original discharged after having passed on the running platen 21. The original fed from the feeding tray 22 is read by the carriage 18 and the reduction optical system 20 when passing on the running platen 21.

Figure 2:
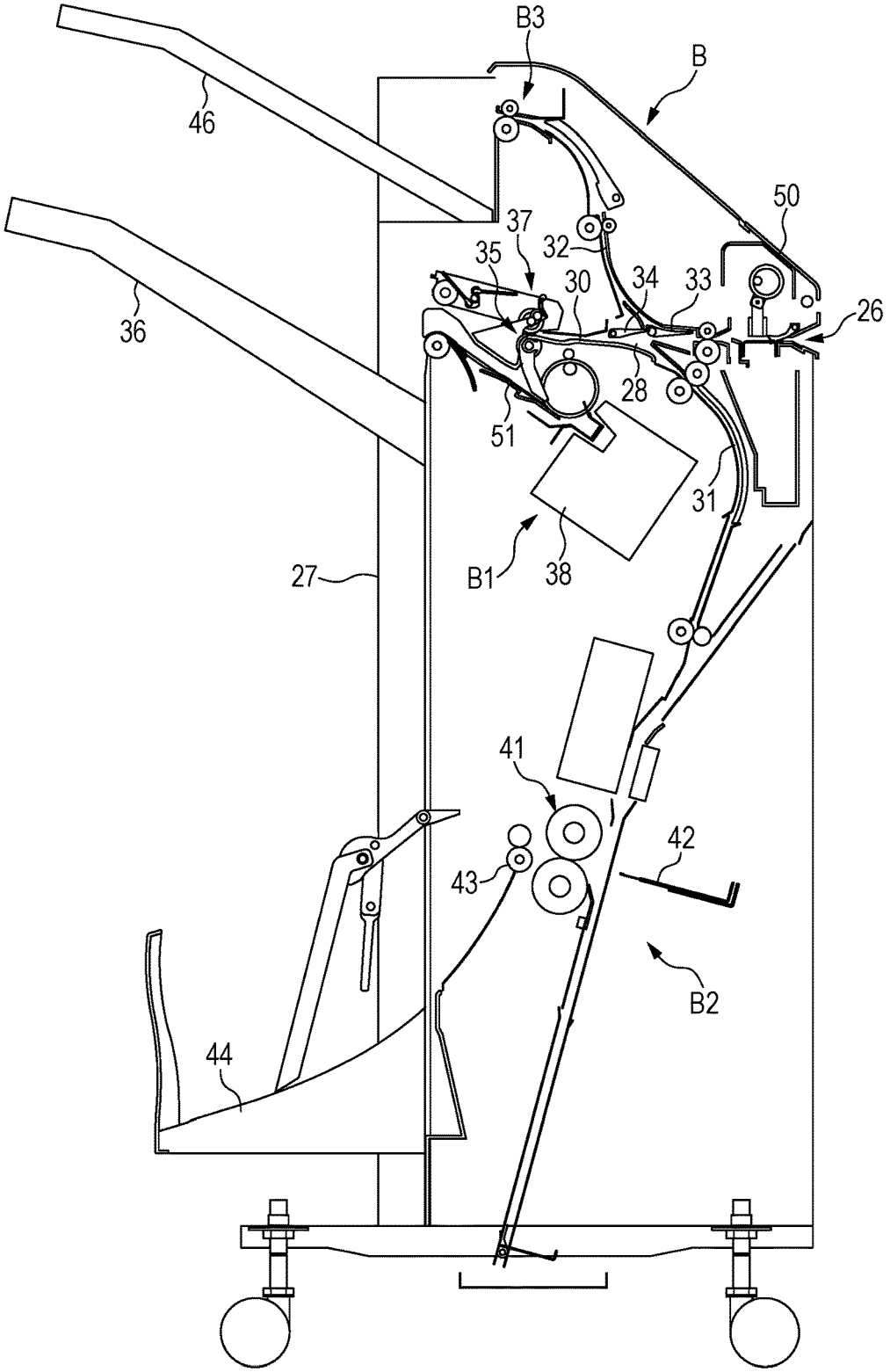
FIG. 2 is an explanatory view of the overall structure of a post-processing apparatus in the image forming system of FIG. 1.

FIG. 2 is an illustration of a configuration of the sheet post-processing apparatus B configured to perform post-processing on a sheet fed from the image forming apparatus A, on which an image is formed. The sheet post-processing apparatus B includes an apparatus housing 27 having a carry-in port 26 configured to introduce the sheet from the image forming apparatus A. The apparatus housing 27 is arranged at a position corresponding to the main body housing 1 of the image forming apparatus A so that the carry-in port 26 communicates with the sheet discharge port 16 of the image forming apparatus A.

The sheet post-processing apparatus B includes a sheet carry-in path 28 configured to convey a sheet introduced from the carry-in port 26, a first sheet discharge path 30, a second sheet discharge path 31, and a third sheet discharge path 32, which branch off from the sheet carry-in path 28, a first path-switching apparatus 33, and a second path-switching apparatus 34. Each of the first and second path-switching apparatus 33 and 34 includes a flapper guide configured to change a direction of conveyance of a sheet conveyed on the sheet carry-in path 28.

The first path-switching apparatus 33 is configured to be switched by a driving device (not shown) into a mode of guiding a sheet from the carry-in port 26 to the third sheet discharge path 32 and a mode of guiding the sheet to a direction toward the first sheet discharge path 30 or the second sheet discharge path 31. The first sheet discharge path 30 and the second sheet discharge path 31 are arranged to communicate with each other so as to enable switch-back conveyance of reversing the conveyance direction of a sheet which has once been introduced to the first sheet discharge path 30 and introducing the sheet to the second sheet discharge path 31.

The second path-switching apparatus 34 is arranged downstream of the first path-switching apparatus 33. The second path-switching apparatus 34 is configured to be switched by a driving device (not shown) into a mode of introducing a sheet which has passed under the first path-switching apparatus 33 to the first sheet discharge path 30 and a switch-back conveyance mode of causing a sheet which has once been introduced to the first sheet discharge path 30 to be further introduced to the second sheet discharge path 31.

The sheet post-processing apparatus B includes a first processing portion B1, a second processing portion B2, and a third processing portion B3, which perform different post-processing schemes, respectively. Further, a punching unit 50 configured to form a punch hole in a fed sheet is arranged on the sheet carry-in path 28.

Figure 6:
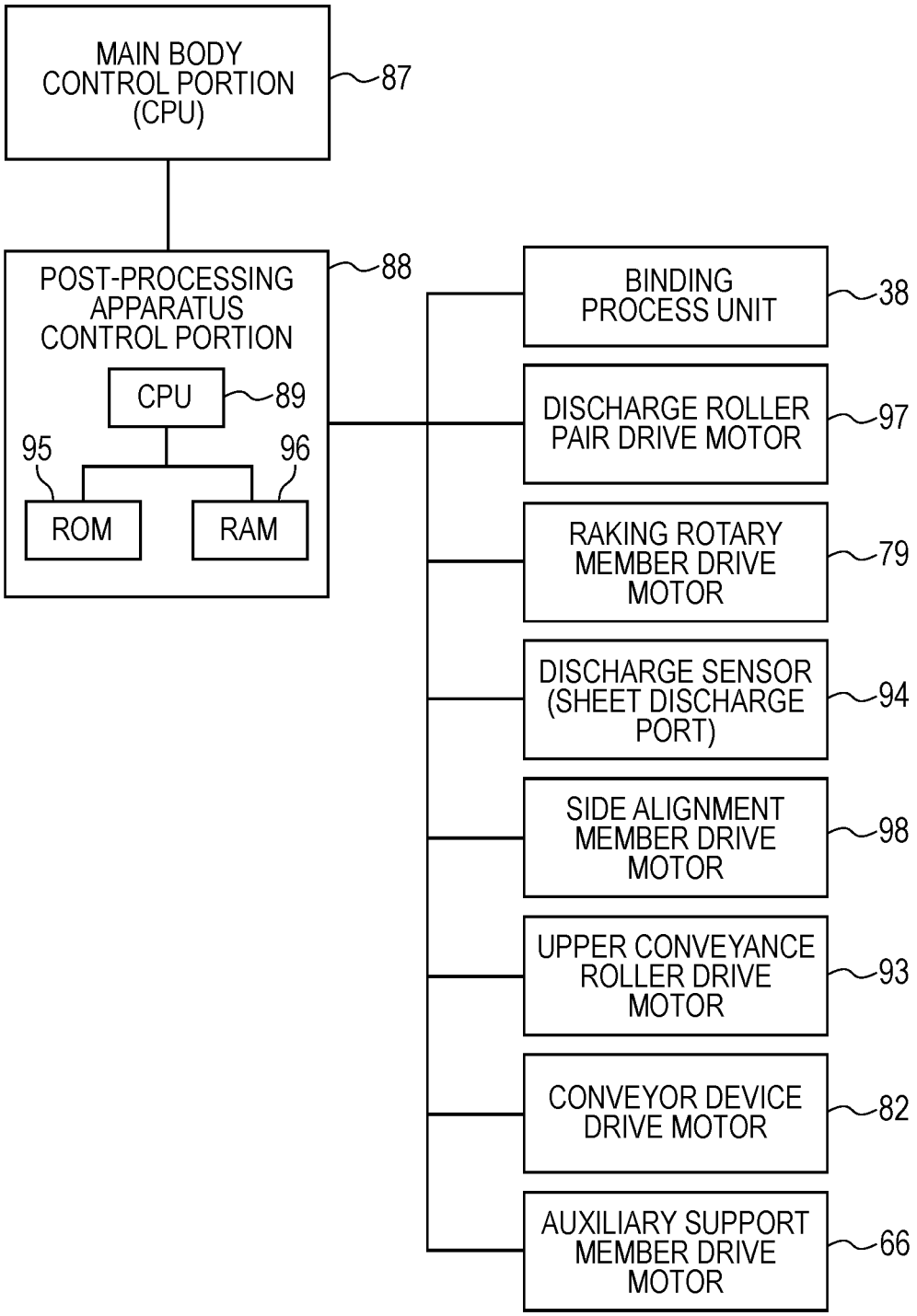
FIG. 6 is an explanatory diagram of the control structure in the sheet stacking apparatus.

The first processing portion B1 is a binding process portion configured to stack, align, and bind a plurality of sheets conveyed from a sheet discharge port 35 at a downstream end of the first sheet discharge path 30, and to discharge the sheets onto a stack tray (second sheet placement portion) 36 arranged outside the apparatus housing 27. As described later, the first processing portion B1 includes a sheet stacking apparatus 37 according to the embodiment configured to convey a sheet or a bundle of sheets, and a binding unit 38 configured to bind the bundle of sheets. A discharge roller pair 39 configured to discharge sheets through the sheet discharge port 35 is arranged at the downstream end of the first sheet discharge path 30. The discharge roller pair 39 is rotated by a discharge roller pair drive motor 97 (FIG. 6).

The second processing portion B2 is configured to bundle a plurality of sheets switchback-conveyed from the second sheet discharge path 31 to form a bundle of sheets, bind the bundle of sheets at a central portion, and then fold the bundle of sheets. In folding, the bundle of sheets is arranged so that its folding position is located at a nip portion of a pair of folding rolls 41 brought into pressure contact with each other. Then, a folding blade 42 is inserted from an opposite side, and the pair of folding rolls 41 is rotated to fold the bundle of sheets. The folded bundle of sheets is discharged by discharge rollers 43 to a stack tray 44 arranged outside the apparatus housing 27.

The third processing portion B3 is configured to perform jog-sorting to sort sheets conveyed from the third sheet discharge path 32 into a group in which sheets are stacked with a predetermined amount of offset in a direction perpendicular to a direction of conveyance, and a group in which sheets are stacked without offset. The sheets subjected to the jog-sorting are discharged to a stack tray 46 arranged outside the apparatus housing 27, and offset bundles of sheets and bundles of sheets having no offset are stacked on top of each other.

Figure 3:
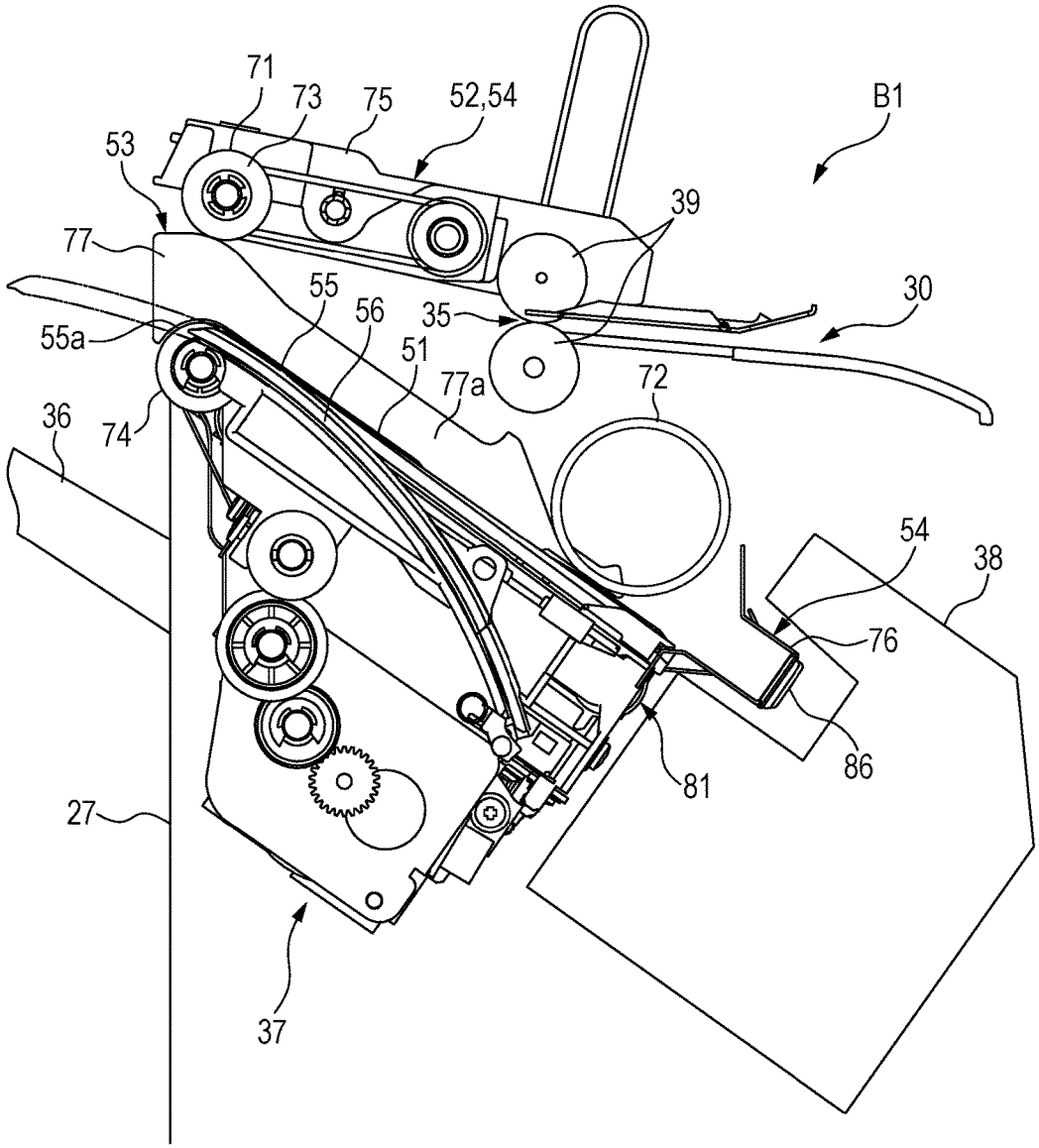
FIG. 3 is a side sectional view of the vicinity of a binding unit of the post-processing apparatus of FIG. 2.

The overall structure of the first processing portion B1 according to the exemplary embodiment is schematically illustrated in FIG. 3. As described above, the first processing portion B1 includes the sheet stacking apparatus 37 configured to stack and align sheets from the sheet discharge port 35, and then discharge the bound sheets onto the stack tray 36, and the binding unit 38 configured to bind the bundle of sheets stacked and aligned by the sheet stacking apparatus 37. The binding unit 38 illustrated in FIG. 3 is a stapler apparatus configured to drive a staple into the bundle of sheets to bind the bundle of sheets. A stapleless binding apparatus configured to bind a bundle of sheets without a staple may also be used as the binding unit 38 instead of the stapler apparatus.

The sheet stacking apparatus 37 includes a processing tray (first sheet placement portion) 51 arranged downstream of the sheet discharge port 35 and spaced downwardly by a predetermined distance from the sheet discharge port 35. The sheet stacking apparatus 37 includes a sheet carry-in mechanism (sheet bundle forming portion) 52 configured to convey a sheet to be subjected to binding, which is discharged from the sheet discharge port 35 to the processing tray 51, to a back side of the processing tray 51, that is, to an opposite side to a direction of carry-out to the stack tray 36, a sheet alignment mechanism 53 configured to stack a plurality of sheets on the processing tray 51 in a bundle form to position the sheets, and a sheet carry-out mechanism 54 configured to convey the bound sheets to the stack tray 36.

Figure 4:
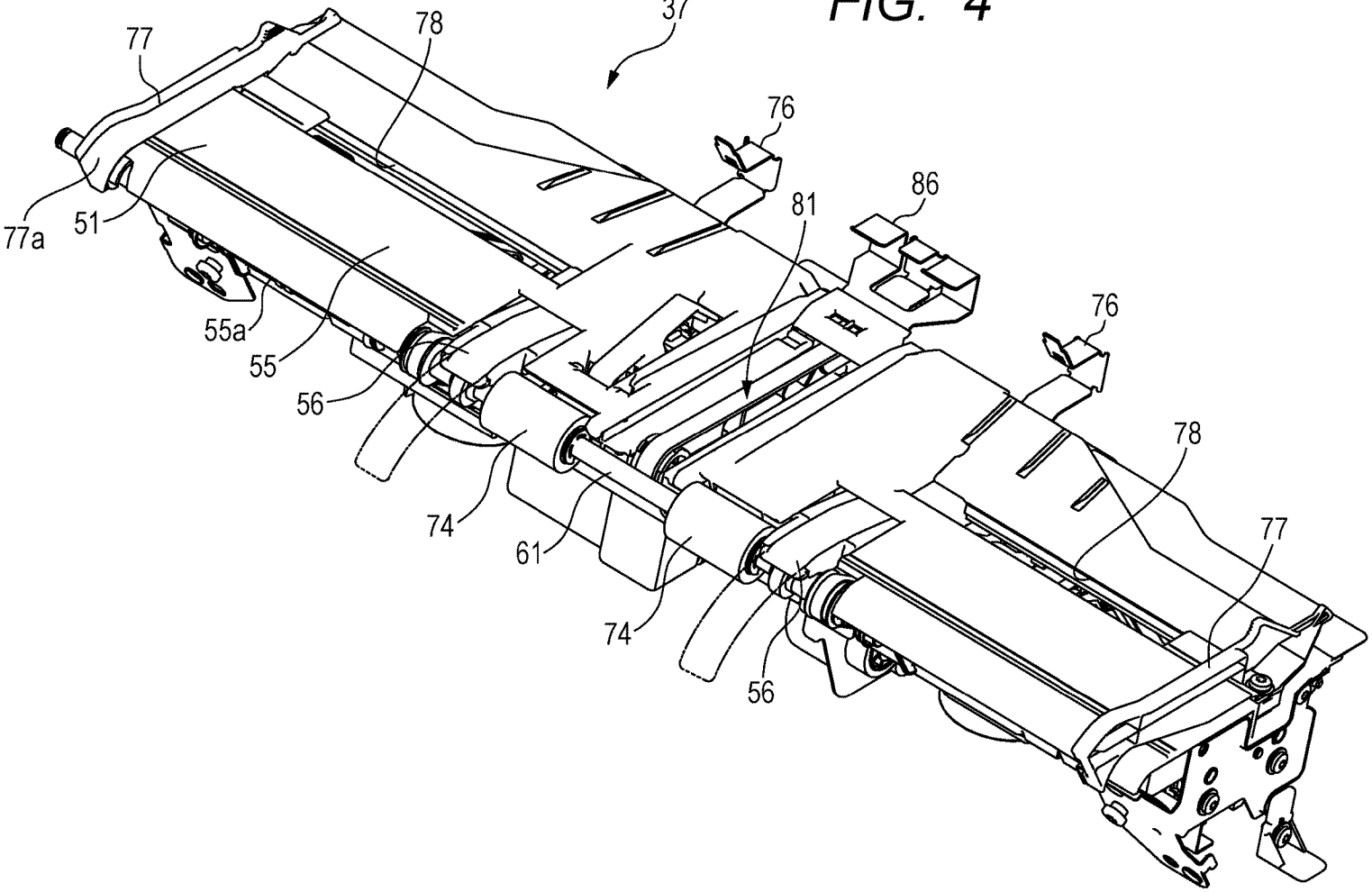
FIG. 4 is an overall perspective view of a sheet stacking apparatus according to an exemplary embodiment of the present invention.

As illustrated in FIG. 4, the processing tray 51 has a substantially flat sheet placing surface 55 configured to at least partially support a sheet placed on its upper surface along its carry-out direction. The sheet placing surface 55 is inclined downward with a relatively large angle of about 40° from downstream toward upstream in the carry-out direction. The processing tray 51 includes a pair of right and left auxiliary support members 56 which are protrudable and retractable with respect to the downstream of a downstream edge 55*a* of the sheet placing surface 55 and toward a position above the stack tray 36. The auxiliary support members 56 are each reciprocated along the carry-out direction through forward and reverse rotations of an auxiliary support member drive motor 66 (FIG. 6).

The sheet carry-in mechanism 52 includes a conveyance roller apparatus 71 also serving as a sheet bundle carry-out mechanism 54 as described later, and a raking rotary member 72. The conveyance roller apparatus 71 includes two roller pairs arranged on right and left in the width direction (direction crossing a sheet conveyance direction in which the sheet is conveyed by the sheet carry-in mechanism 52). Each roller pair has an upper conveyance roller 73 and a lower conveyance roller 74 with respect to the processing tray 51 located therebetween. The upper conveyance roller 73 is rotatably supported at a distal end of a vertically movable bracket 75 swingably supported above the processing tray 51, and the lower conveyance roller 74 is rotatably mounted on a support rod 61 on the lower side of the processing tray 51. The upper conveyance roller 73 is rotated by an upper conveyance roller drive motor 93 (FIG. 6). The raking rotary member 72 is rotated by a raking rotary member drive motor 79 (FIG. 6).

When the sheet is discharged from the sheet discharge port 35 to the processing tray 51, the vertically movable bracket 75 is turned downward to bring the upper conveyance roller 73 into contact with an upper surface of the sheet on the processing tray 51. Next, the upper conveyance roller 73 is driven to rotate in a counterclockwise direction in FIG. 3 and the lower conveyance roller 74 is driven to rotate in a clockwise direction in FIG. 3. This allows the sheet to be conveyed on the processing tray 51 in a carry-in direction, that is, in a direction opposite to the carry-out direction (direction toward sheet edge regulating members 76).

The raking rotary member 72 is formed of a ring-shaped or short cylindrical belt member rotatably arranged above the processing tray 51 on upstream in the carry-out direction. The raking rotary member 72 rotates in the counterclockwise direction in FIG. 3 while being in contact with and pressing the upper surface of the sheet being conveyed on the processing tray 51. This allows the sheet to be fed until its leading edge comes into contact with the sheet edge regulating members 76 provided at an upstream end of the processing tray 51 in the carry-out direction while protecting the sheet being conveyed from curling and skewing which may occur. Each sheet edge regulating member 76 is formed of, for example, a channel-like member having a U-shaped (or square-bracket-shaped) cross-section illustrated in FIG. 4.

The sheet alignment mechanism 53 includes a sheet edge restricting portion and a side alignment mechanism. The sheet edge restricting portion has the above-mentioned pair of sheet edge regulating members 76 arranged on right and left. The sheet edge regulating members 76 restrict, in the carry-in (or carry-out) direction, the position of the sheet having entered from the sheet discharge port 35 on the processing tray 51 at the leading edge of the sheet in the carry-in direction (or at a trailing edge of the sheet in the carry-out direction).

The side alignment mechanism moves a sheet or a bundle of sheets on the processing tray 51 in the width direction to restrict and/or align the positions in the width direction at side edges. As illustrated in FIG. 4, the side alignment mechanism includes a pair of side alignment members 77 arranged on right and left with respect to a center of the processing tray 51 in its width direction. The side alignment members 77 are each formed of a tabular member protruding vertically upward from the sheet placing surface 55 of the processing tray 51, with their inner surfaces facing each other. The inner surface of each side alignment member 77 is engaged with the adjacent side edge in the width direction of the sheet on the processing tray 51 to restrict the position of the sheet in its width direction.

Each side alignment member 77 is integrally connected to a movable support portion (not shown) provided on a back side of the processing tray 51 through a linear slit 78 in the width direction, which is formed in the processing tray 51. Each of the movable support portions is driven by an individual side alignment member drive motor 98 (FIG. 6) through intermediation of, for example, a rack-and-pinion mechanism to be moved from side to side in the width direction so that the respective side alignment members 77 can be moved independently of each other in directions of becoming closer to or away from each other to be stopped at desired positions in the width direction.

Figure 5:
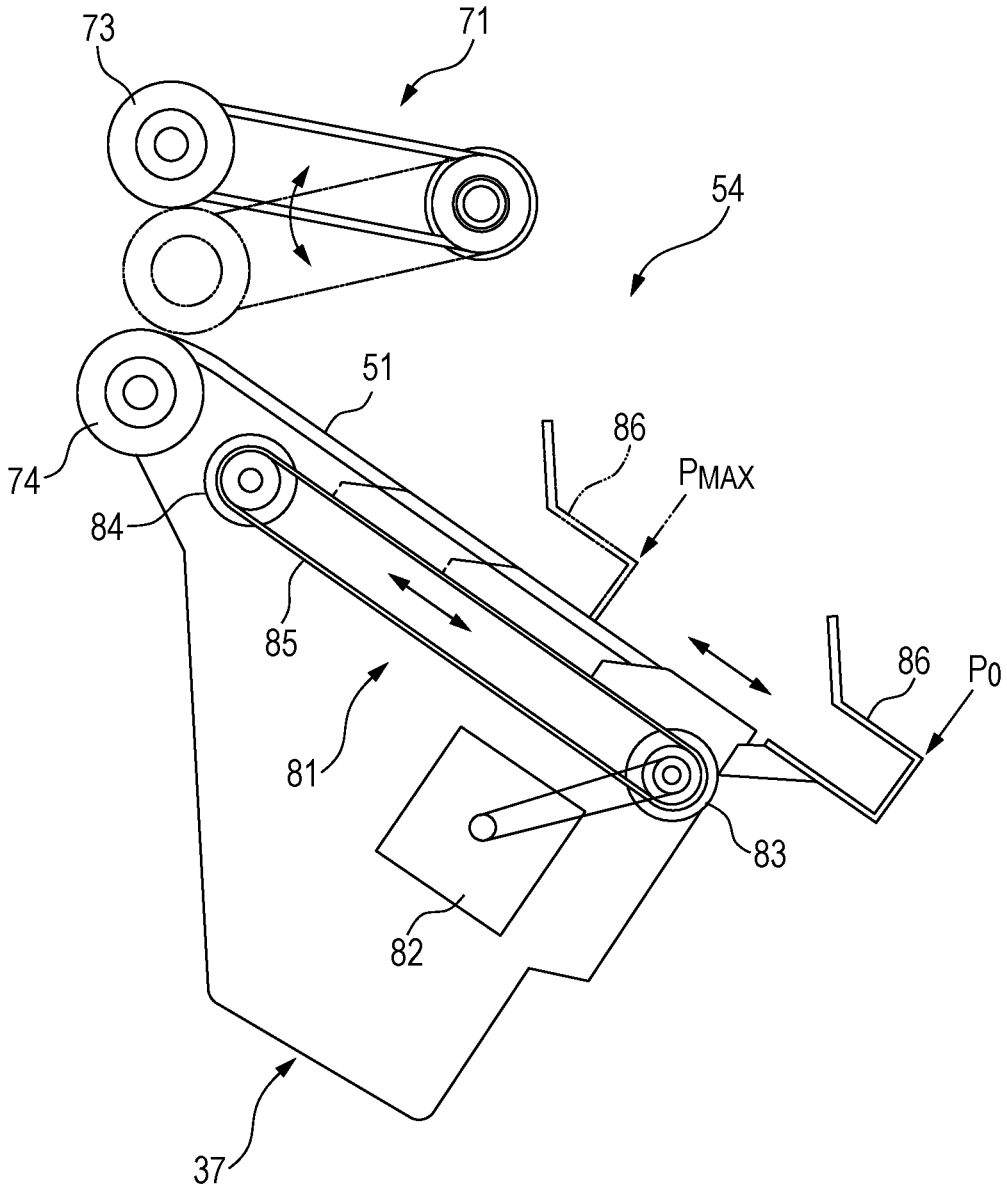
FIG. 5 is a schematic structural view of a sheet conveyance mechanism.

As illustrated in FIG. 5, the sheet carry-out mechanism 54 includes a conveyor device 81 and the above-mentioned conveyance roller apparatus 71. The conveyor device 81 includes a conveyor belt 85 stretched around a drive pulley 83 driven by a conveyor device drive motor 82 and a driven pulley 84, and circumferentially moving in both directions along the carry-out direction of the sheet. A sheet push-out member (sheet moving portion) 86 moving along the sheet placing surface 55 of the processing tray 51 is fixed to the conveyor belt 85.

The sheet push-out member 86 is arranged to be movable in both directions between an initial position $P_0$ near the upstream end of the processing tray 51 in the carry-out direction and a maximum push-out position $P_{MAX}$ set substantially midway between the drive pulley 83 and the driven pulley 84. The sheet push-out member 86 is formed of, for example, a channel-like member having a U-shaped (square-bracket-shaped) cross-section illustrated in FIG. 4, and is configured to feed out the sheet in the carry-out direction so that the trailing edge of the sheet or the upstream edge of the sheet in the carry-out direction on the sheet placing surface 55 is pushed out. Further, the sheet push-out member 86 serves as a part of the sheet edge restricting portion to restrict a trailing edge position of the sheet at least at a position to which the sheet push-out member 86 is moved in the carry-out direction from the initial position $P_0$.

The conveyance roller apparatus 71 is arranged so that the upper conveyance roller 73 and the lower conveyance roller 74 in each pair nip the sheet from above and below at the vicinity of a downstream end of the processing tray 51 in the carry-out direction in a conveyable manner. As illustrated in FIG. 4, the roller pairs 73 and 74 on right and left are arranged so as to be symmetric with respect to the center of the processing tray 51 in the width direction.

A series of operations including feeding and stacking a plurality of sheets to and on the processing tray 51, aligning the sheets, forming a bundle of sheets including a predetermined number of sheets, and then discharging the bound sheets to the stack tray 36 in the first processing portion B1 of the sheet post-processing apparatus B according to the embodiment will be described below. The series of operations can be controlled by a post-processing apparatus control portion 88 (FIG. 6) arranged in the sheet post-processing apparatus B, as described later.

The control structure of the image forming system 100 including the sheet stacking apparatus 37 according to the above-mentioned embodiment is illustrated in FIG. 6, and the image forming system includes the main body control portion 87 of the image forming apparatus A and the post-processing apparatus control portion 88 of the sheet post-processing apparatus B, which is connected to the main body control portion 87. The main body control portion 87 provides, to the post-processing apparatus control portion 88, information on feeding of sheets from the image forming apparatus A to the sheet post-processing apparatus B.

The post-processing apparatus control portion 88 includes a CPU (control portion) 89, and a ROM (storage portion) 95 and a RAM (storage portion) 96 connected to the CPU 89, and executes post-processing in the first processing portion B1 based on a control program stored in the ROM 95 and control data stored in the RAM 96. Therefore, all of the above-mentioned drive motors and sensors are connected to the CPU 89 of the post-processing apparatus control portion 88 and the CPU 89 controls drive of the respective drive motors.

The post-processing apparatus control portion 88 obtains, from the main body control portion 87, information related to the number and size of sheets included in a bundle of sheets to be formed by the sheet stacking apparatus 37. When the sheet size of the bundle of sheets to be formed is a large size, the post-processing apparatus control portion 88 selects a first mode. When the sheet size of the bundle of sheets to be formed is a small size, the post-processing apparatus control portion 88 selects a second mode.

Sorting of the sheets according to the large size or the small size is determined in advance in accordance with sheet sizes in the carry-out direction from the processing tray 51 to the stack tray 36. For example, in the embodiment, the following sorting can be performed in accordance with types of sheets to be fed from the image forming apparatus A.

Large Size: A3, B4, Legal, ledger, A4 short edge feed, and Letter short edge feed Small Size: A4 long edge feed, Letter long edge feed, and B5 long edge feed Thus, it is only necessary that the main body control portion 87 gives the post-processing apparatus control portion 88 the instructions as to whether the sheet to be subjected to the post-processing has the large size or the small size.

In any of the first mode and the second mode, when the number of sheets included in the bundle of sheets corresponding to the number of originals in the image forming apparatus A is specified by the main body control portion 87, the post-processing apparatus control portion 88 divides the number of sheets, forms a plurality of subdivided bundles of sheets on the processing tray 51, and sequentially conveys the subdivided bundles of sheets to the stack tray 36. The maximum number of sheets included in each subdivided bundle of sheets formed in the second mode is set to be smaller than the maximum number of sheets included in each subdivided bundle of sheets formed in the first mode. That is, the number of sheets conveyed at once to the stack tray 36 in the second mode is smaller than the number of sheets conveyed at once to the stack tray 36 in the first mode.

For example, it is assumed that the maximum number of sheets included in each subdivided bundle of sheets formed in the first mode is three, and the maximum number of sheets included in each subdivided bundle of sheets formed in the second mode is two. When the number of originals is ten, and the sheet size is the large size, the post-processing apparatus control portion 88 having selected the first mode divides ten sheets of the bundle of sheets to be finally placed on the stack tray 36 into three subdivided bundles of sheets, each including three sheets, and one fractional sheet. When the number of originals is the same, and the sheet size is the small size, the post-processing apparatus control portion 88 divides the ten final sheets of the bundle of sheets into five subdivided bundles of sheets each including two sheets. The subdivided bundles of sheets (and a fractional sheet) are aligned for each bundle of sheet including ten sheets and discharged to the stack tray 36.

Figure 7A:
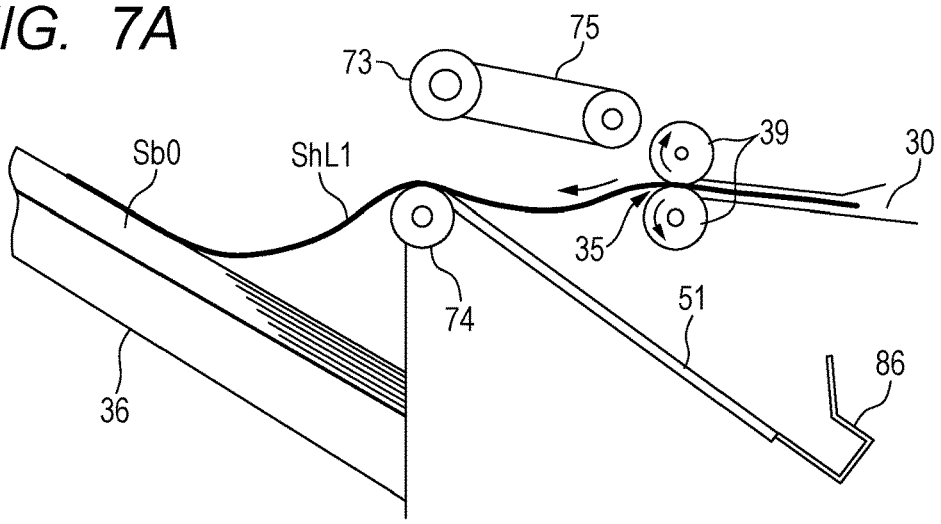
FIGS. 7A, 7B and 7C are schematic explanatory views for illustrating a process of conveying a plurality of sheets to a processing tray in a first mode.
Figure 7B:
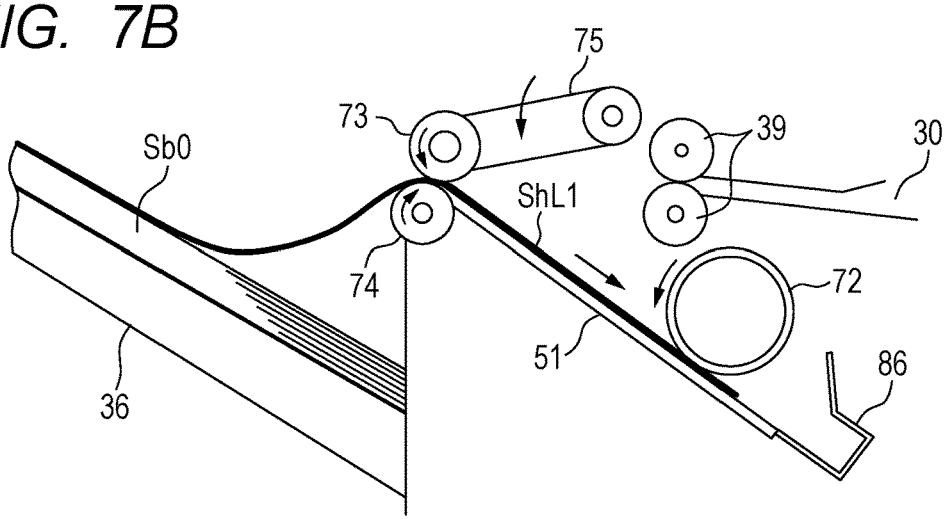
Figure 7C:
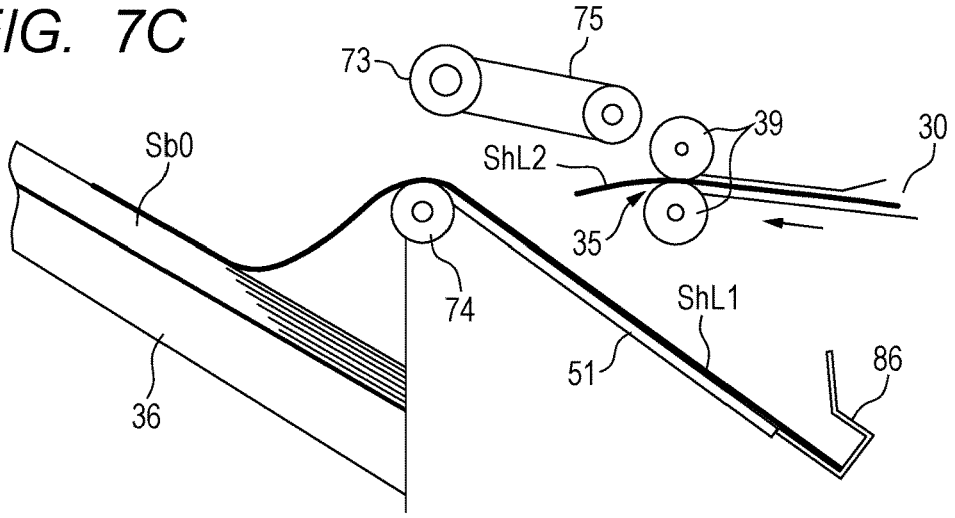

First, a process of stacking a plurality of large size sheets ShL on the processing tray 51 to form a bundle of sheets SbL in the first mode and thereafter conveying the bundle of sheets SbL to the stack tray 36 is described with reference to the attached drawings. FIG. 7A to FIG. 7C are illustrations of a process of conveying a sheet ShL1 to the processing tray 51. FIG. 8A to FIG. 8C, FIG. 9A, and FIG. 9B are illustrations of a process of stacking a succeeding sheet ShL2 on the processing tray 51 to form a bundle of sheets SbL. FIG. 10A to FIG. 10D are illustrations of a process of conveying the bundle of sheets SbL on the processing tray 51 to the stack tray 36.

First, as illustrated in FIG. 7A, the sheet ShL1 is discharged through the sheet discharge port 35 to the processing tray 51. A discharge sensor 94 arranged at the vicinity of the first sheet discharge path 30 and the sheet discharge port 35 detects a trailing edge of the sheet ShL, to thereby detect discharge of the sheet ShL1 to the processing tray 51. Then, the sheet carry-in mechanism 52 is operated. As illustrated in FIG. 7B, the vertically movable bracket 75 is turned downward to bring the upper conveyance roller 73 into contact with the upper surface of the sheet on the processing tray 51. The upper conveyance roller 73 is rotated in the counterclockwise direction, and the raking rotary member 72 is also turned in the counterclockwise direction, to thereby convey the sheet ShL1 in the carry-in direction.

Figure 8A:
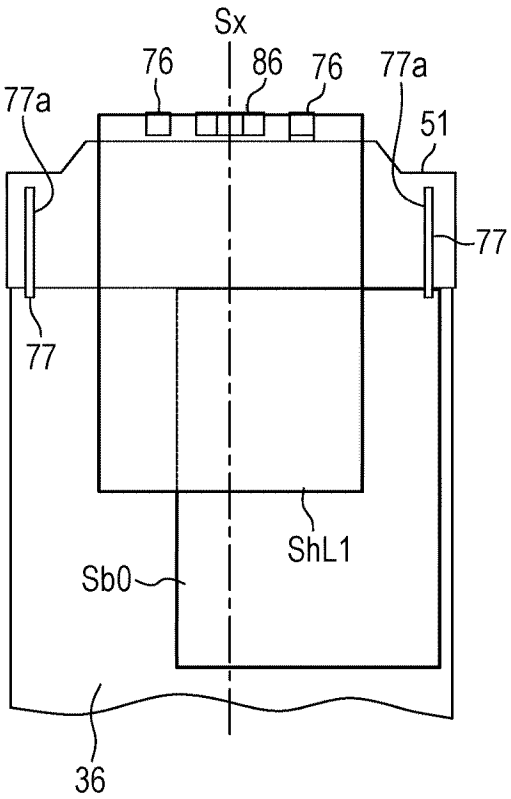
FIGS. 8A, 8B and 8C are schematic explanatory views for illustrating a process of conveying and stacking a succeeding sheet on the processing tray, which are subsequent to FIG. 7C.

As illustrated in FIG. 7C and FIG. 8A, after the sheet ShL1 is conveyed until the leading edge of the sheet ShL1 comes into contact with the sheet edge regulating members 76, the upper conveyance roller 73 and the raking rotary member 72 are stopped. At this time, a downstream end portion of the sheet ShL1 in the carry-out direction is in surface-contact with an upper surface of a bundle of sheets Sb0 on the stack tray 36, and the sheet ShL1 is supported so as to extend over the processing tray 51 and the stack tray 36.

In the embodiment, in a state in which the trailing edge of the large size sheet ShL1 in the carry-out direction is held in contact with the sheet edge regulating members 76, the downstream end portion of the large size sheet ShL1 in the carry-out direction comes into surface-contact with the upper surface of the bundle of sheets Sb0 on the stack tray 36 with a relatively large ratio with respect to an entire area of the sheet ShL1. As a matter of course, even with a sheet having the same sheet size (length in the carry-out direction), the ratio of an area in surface-contact with the upper surface of the bundle of sheets on the stack tray 36 differs depending on the length of the sheet placing surface 55 of the processing tray 51 in the carry-out direction. Thus, the maximum sheet size (length in the carry-out direction) to be handled by the image forming apparatus A may be identified as the large size, and all of sheets having a smaller sheet size (length in the carry-out direction) than the maximum sheet size may be identified as the small size, to thereby perform selection of the first mode or the second mode.

Figure 8B:
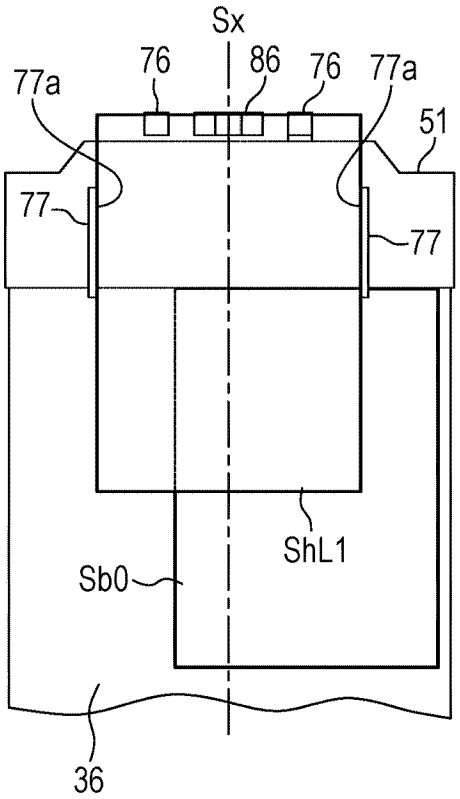

Next, the right and left side alignment members 77 at retreated positions in FIG. 8A are moved inward so as to hold the sheet ShL1 from both sides. The side alignment members 77 are engaged, at respective regulating surfaces 77*a* thereof, with both side edges of the sheet ShL1, and moved to positions at which the distance of separation of the regulating surfaces 77*a* matches with the width dimension of the sheet ShL1. With this, as illustrated in FIG. 8B, a center of the sheet ShL1 in the width direction is aligned with a stacking position matching with a center reference Sx of the processing tray 51. After that, the side alignment members 77 are returned to the retreated positions of FIG. 8A.

Figure 8C:
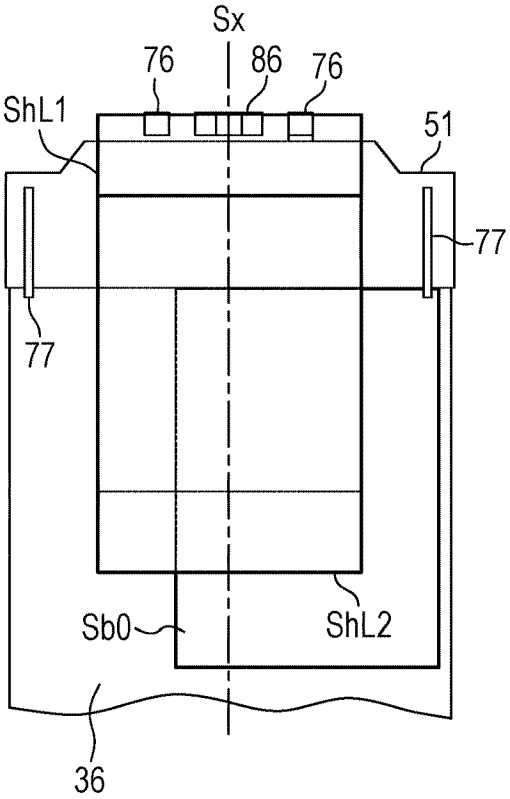

As illustrated in FIG. 8C, the next sheet ShL2 is discharged onto the preceding sheet ShL1 on the processing tray 51 as in FIG. 7A. The next sheet ShL2 is conveyed until the leading edge of the next sheet ShL2 comes into contact with the sheet edge regulating members 76 by rotating the upper conveyance roller 73 and the raking rotary member 72 as in FIG. 7B. Next, as in FIG. 8A, the side alignment members 77 are moved inward to hold the sheet ShL2 from both sides with the regulating surfaces 77*a*, and a center of the sheet ShL2 in the width direction is aligned with the center reference Sx of the processing tray 51. With this, as illustrated in FIG. 9A, the next sheet ShL2 is aligned with and stacked on the preceding sheet ShL1 on the processing tray 51.

Figure 9B:
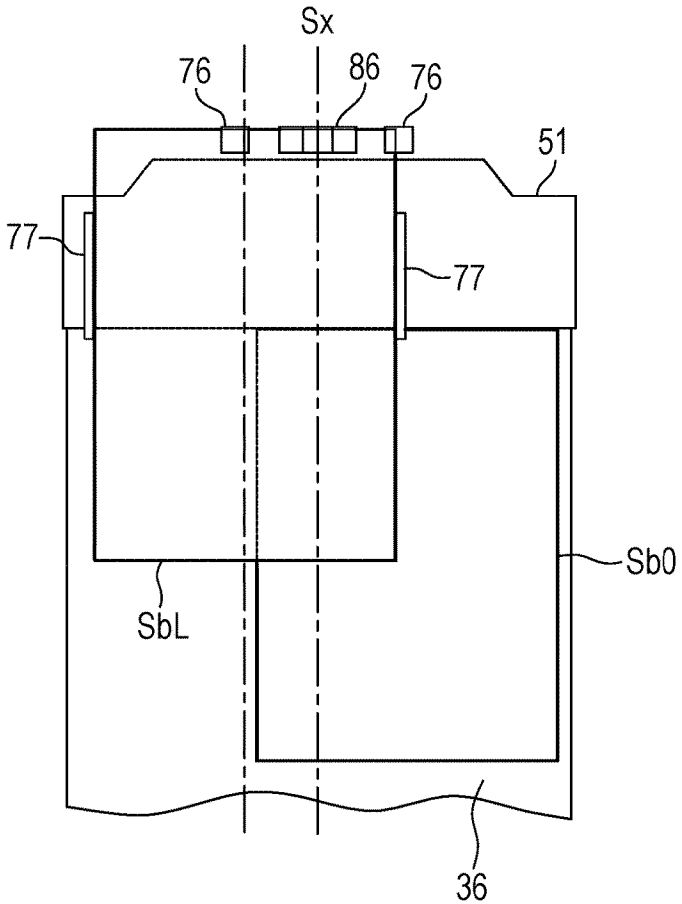
FIGS. 9A and 9B are schematic explanatory views for illustrating a process of conveying and stacking the succeeding sheet on the processing tray, which are subsequent to FIG. 8C.
Figure 9A:
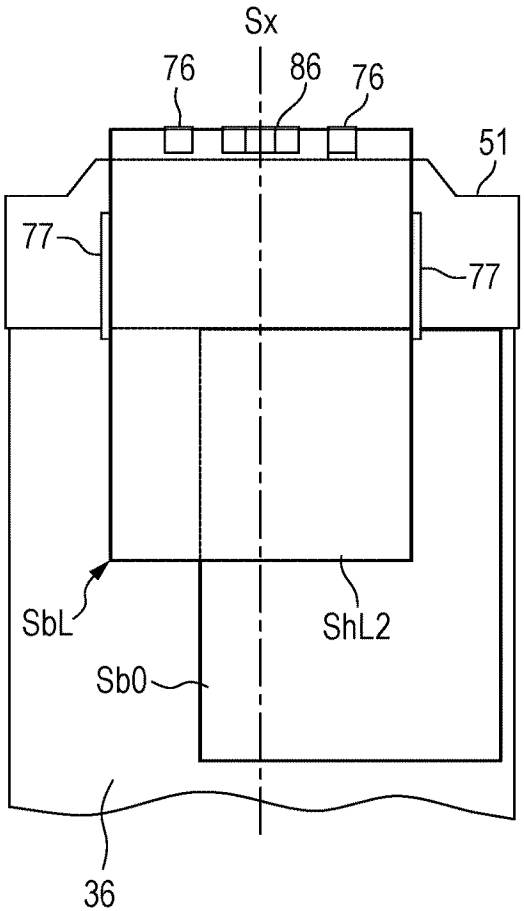

The above-mentioned processes in FIG. 8C and FIG. 9A are repeated, to thereby form the bundle of sheets SbL including a predetermined number of sheets on the processing tray 51. The predetermined number herein is not the number of sheets included in the bundle of sheets corresponding to the number of originals. As described above, the predetermined number is the number of sheets of the subdivided bundle of sheets formed by dividing the bundle of sheets.

The formed bundle of sheets SbL can be moved to offset by a predetermined distance in the width direction, that is, a direction perpendicular to the carry-out direction as needed.

The offset movement is performed by moving the side alignment members 77 in the width direction as illustrated in FIG. 9B while holding the bundle of sheets SbL from both sides, without returning the side alignment members 77 to the retreated positions.

Figure 10A:
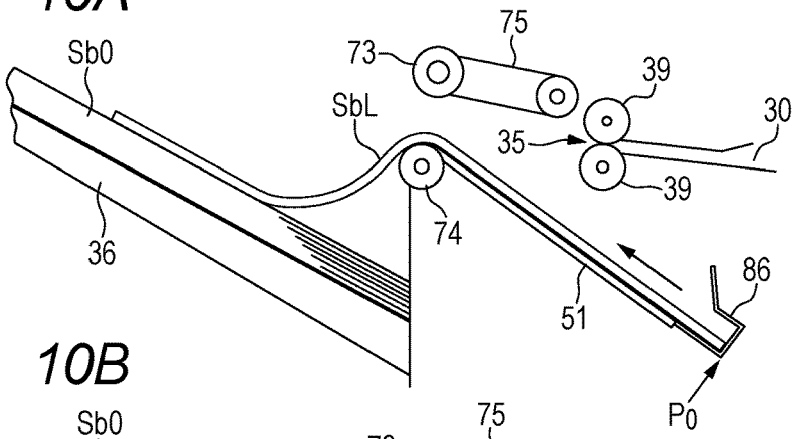
FIGS. 10A, 10B, 10C and 10D are schematic explanatory views for illustrating a process of conveying a bundle of sheets from the processing tray to a stack tray, which are subsequent to FIG. 9B.

Next, the bundle of sheets SbL having been formed on the processing tray 51 and moved to offset as needed is conveyed to the stack tray 36 by the sheet carry-out mechanism 54. While the bundle of sheets SbL is held by the side alignment members 77 from both sides as illustrated in FIG. 9B, the conveyor device 81 is operated, and the sheet push-out member 86 is driven to move from the initial position $P_0$ of FIG. 10A to the maximum push-out position $P_{MAX}$ of FIG. 10B, to thereby convey the bundle of sheets SbL in the carry-out direction. In FIG. 10A, the downstream end portion of the bundle of sheets SbL in the carry-out direction is in surface-contact with the upper surface of the preceding bundle of sheets Sb0 stacked on the stack tray 36.

Figure 10B:
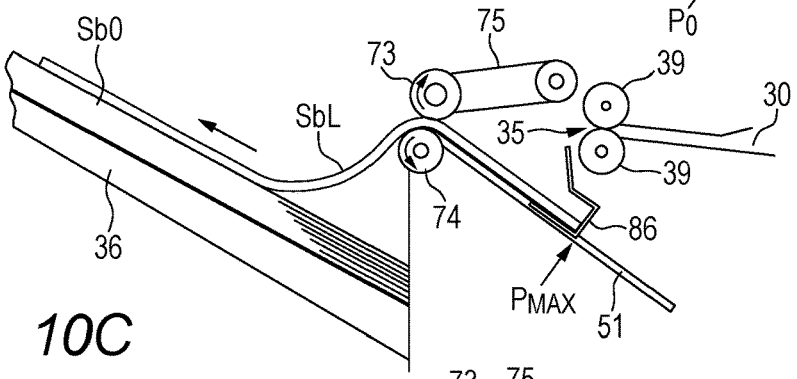
Figure 10C:
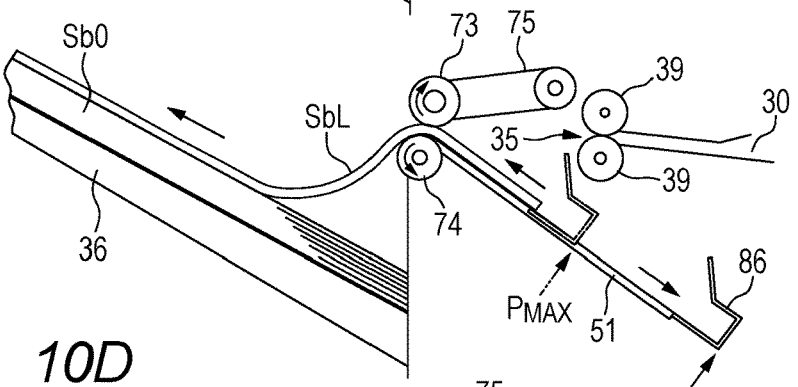
Figure 10D:
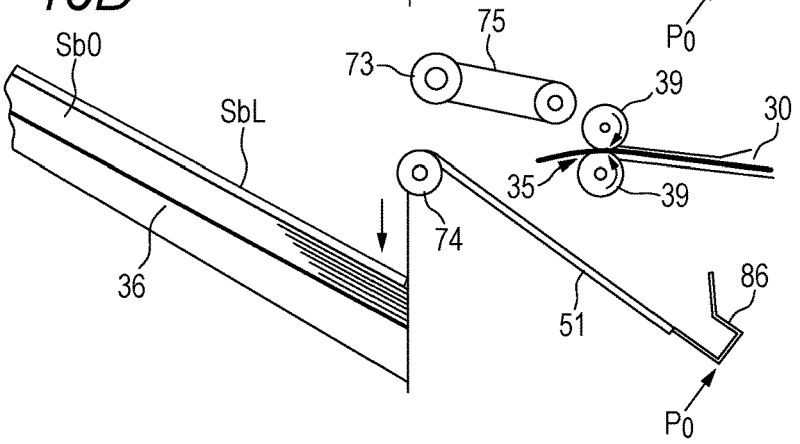

After the sheet push-out member 86 is stopped at the maximum push-out position $P_{MAX}$, as illustrated in FIG. 10B, the upper conveyance roller 73 is moved downward to come into contact with the upper surface of the bundle of sheets SbL, to thereby sandwich the bundle of sheets SbL with the lower conveyance roller 74. As illustrated in FIG. 10C, the upper conveyance roller 73 is driven to rotate in the clockwise direction, and the lower conveyance roller 74 is driven to rotate in the counterclockwise direction, to thereby convey the bundle of sheets SbL in the carry-out direction. The sheet push-out member 86 is returned to the initial position $P_0$ after being stopped at the maximum push-out position $P_{MAX}$. As illustrated in FIG. 10D, the bundle of sheets SbL is conveyed onto the stack tray 36 by the upper and lower conveyance rollers 73 and 74.

In the first mode, in a state in which the trailing edge of the bundle of sheets SbL formed of the large size sheets in the carry-out direction is held in contact with the sheet edge regulating members 76, the downstream end portion thereof in the carry-out direction is in surface-contact with the upper surface of the bundle of sheets Sb0 on the stack tray 36 over a large area as described above. Thus, during a period from the above-mentioned state to the conveyance of the bundle of sheets SbL onto the stack tray 36, a significant part of or at least a considerable part of the force of pushing out the bundle of sheets SbL in the carry-out direction by any one of the sheet push-out member 86 or the upper and lower conveyance rollers 73 and 74 is exerted in the surface direction of the bundle of sheets Sb0 on the stack tray 36, and hence there is less concern of displacement of the uppermost sheet of the bundle of sheets Sb0 on the stack tray 36, thereby being capable of improving a sheet stack alignment property.

Figure 11A:
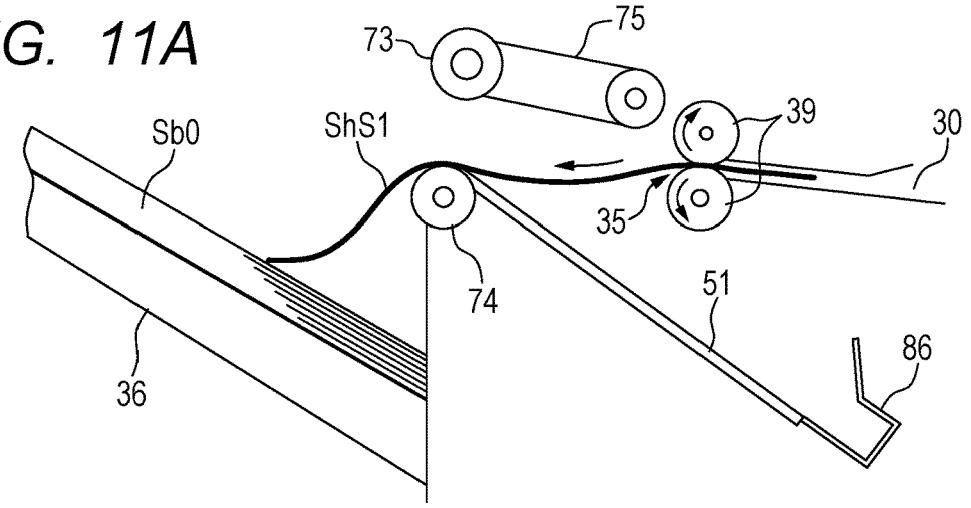
FIGS. 11A, 11B and 11C are schematic explanatory views for illustrating a process of conveying a plurality of sheets to a processing tray in a second mode.
Figure 11B:
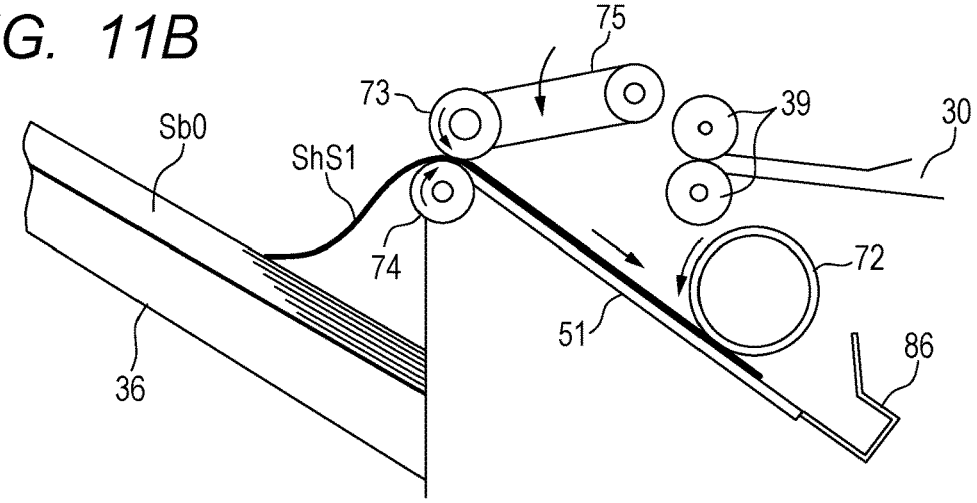
Figure 11C:
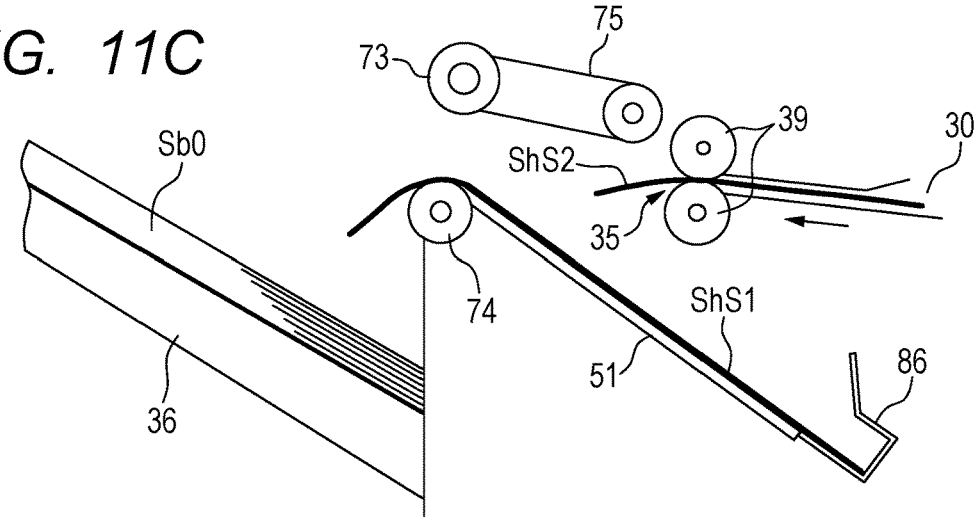

Next, a process of stacking a plurality of small size sheets ShS on the processing tray 51 to form a bundle of sheets SbS in the second mode and thereafter conveying the bundle of sheets SbS to the stack tray 36 will be described with reference to the attached drawings. FIG. 11A to FIG. 11C are illustrations of a process of conveying a sheet ShS1 to the processing tray 51. FIG. 12A to FIG. 12C, FIG. 13A, and FIG. 13B are illustrations of a process of stacking a succeeding sheet ShS2 on the processing tray 51 to form a bundle of sheets SbS. FIG. 14A to FIG. 14D are illustrations of a process of conveying the bundle of sheets SbS on the processing tray 51 to the stack tray 36.

First, as illustrated in FIG. 11A, the sheet ShS1 is discharged through the sheet discharge port 35 to the processing tray 51. The discharge sensor 94 arranged at the vicinity of the first sheet discharge path 30 and the sheet discharge port 35 detects a trailing edge of the sheet ShS1, to thereby detect discharge of the sheet ShS1 to the processing tray 51. Then, the sheet carry-in mechanism 52 is operated. As illustrated in FIG. 11B, the vertically movable bracket 75 is turned downward to bring the upper conveyance roller 73 into contact with the upper surface of the sheet on the processing tray 51. The upper conveyance roller 73 is rotated in the counterclockwise direction, and the raking rotary member 72 is also turned in the counterclockwise direction, to thereby convey the sheet ShS1 in the carry-in direction.

Figure 12A:
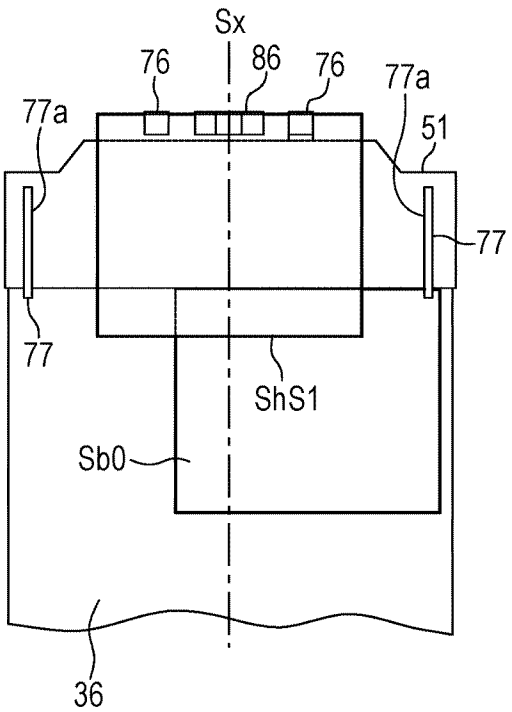
FIGS. 12A, 12B and 12C are schematic explanatory views for illustrating a process of conveying and stacking a succeeding sheet on the processing tray, which are subsequent to FIG. 11C.

As illustrated in FIG. 11C and FIG. 12A, after the sheet ShS1 is conveyed until the leading edge of the sheet ShS1 comes into contact with the sheet edge regulating members 76, the upper conveyance roller 73 and the raking rotary member 72 are stopped. At this time, in a state in which a downstream end portion of the sheet ShS1 in the carry-out direction is separated from the upper surface of the bundle of sheets Sb0 on the stack tray 36, the sheet ShS1 is supported by the processing tray 51.

Figure 15A:
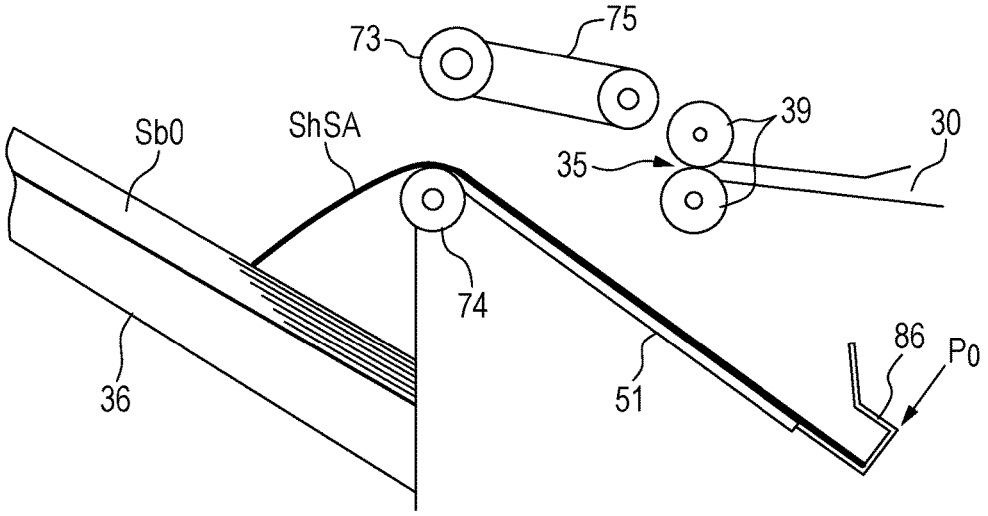
FIGS. 15A and 15B are explanatory views for illustrating examples of different small sizes.
Figure 15B:
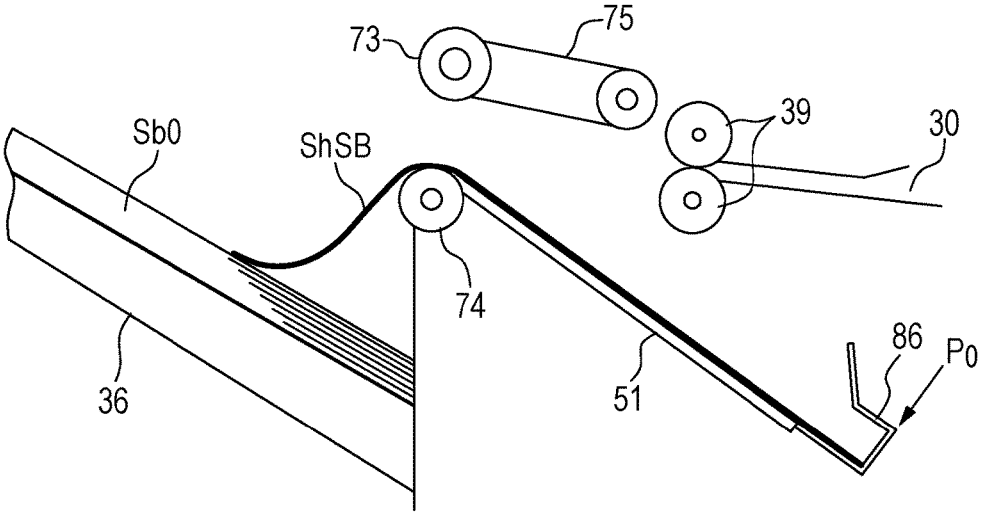

In the embodiment, the sheet ShS1 having such a size that the downstream end portion thereof in the carry-out direction is separated from the upper surface of the bundle of sheets Sb0 on the stack tray 36 in a state in which the trailing edge of the sheet ShS1 in the carry-out direction is in contact with the sheet edge regulating members 76 as described above has a small size. As another specific example of the small size, as illustrated in FIG. 15A, there is a case where a downstream end portion of a sheet ShSA in the carry-out direction is held in abutment at a sheet edge of the sheet ShSA against the upper surface of the bundle of sheets Sb0 on the stack tray 36. Further, as illustrated in FIG. 15B, a case where a downstream end portion of a sheet ShSB in the carry-out direction is in surface-contact with the upper surface of the bundle of sheets Sb0 on the stack tray 36 but the contact area is substantially small may also be included in the small size.

Figure 12B:
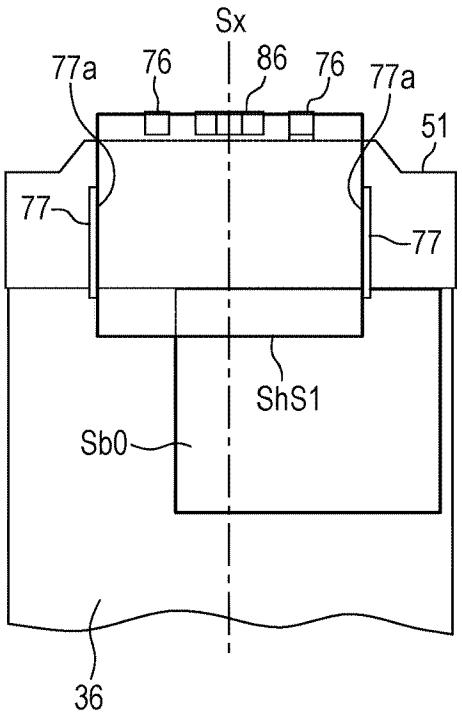

Next, the right and left side alignment members 77 at retreated positions in FIG. 12A are moved inward so as to hold the sheet ShS1 from both sides. The side alignment members 77 are engaged, at the respective regulating surfaces 77*a* thereof, with both side edges of the sheet ShS1, and moved to positions at which the distance of separation of the regulating surfaces 77*a* matches with the width dimension of the sheet ShS1. With this, as illustrated in FIG. 12B, a widthwise center of the sheet ShS1 is aligned with the stacking position matching with the center reference Sx of the processing tray 51. After that, the side alignment members 77 are returned to the retreated positions of FIG. 12A.

Figure 12C:
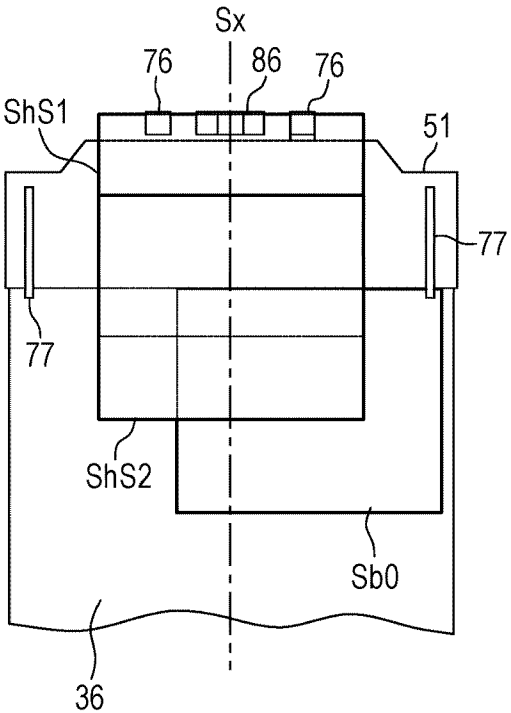

As illustrated in FIG. 12C, the next sheet ShS2 is discharged onto the preceding sheet ShS1 on the processing tray 51 as in FIG. 11A. The next sheet ShS2 is conveyed until the leading edge of the next sheet ShS2 comes into contact with the sheet edge regulating members 76 by rotating the upper conveyance roller 73 and the raking rotary member 72 as in FIG. 11B. Next, as in FIG. 12A, the side alignment members 77 are moved inward to hold the sheet ShS2 from both sides with the regulating surfaces 77*a*, and a center of the sheet ShS2 in the width direction is aligned with the center reference Sx of the processing tray 51. With this, as illustrated in FIG. 13A, the next sheet ShS2 is aligned with and stacked on the preceding sheet ShS1 on the processing tray 51.

Figure 13B:
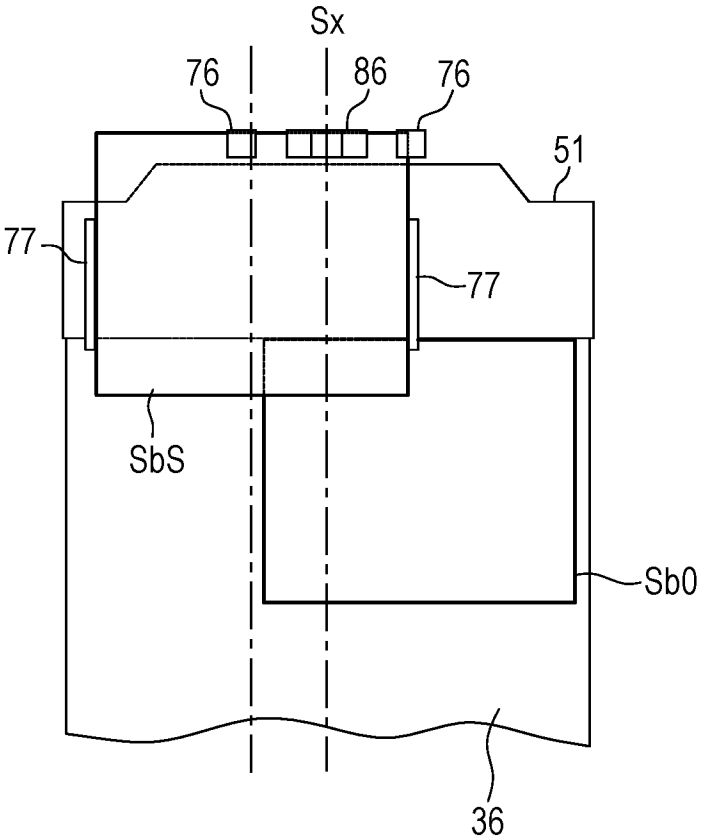
FIGS. 13A and 13B are schematic explanatory views for illustrating a process of conveying and stacking the succeeding sheet on the processing tray, which are subsequent to FIG. 12C.
Figure 13A:
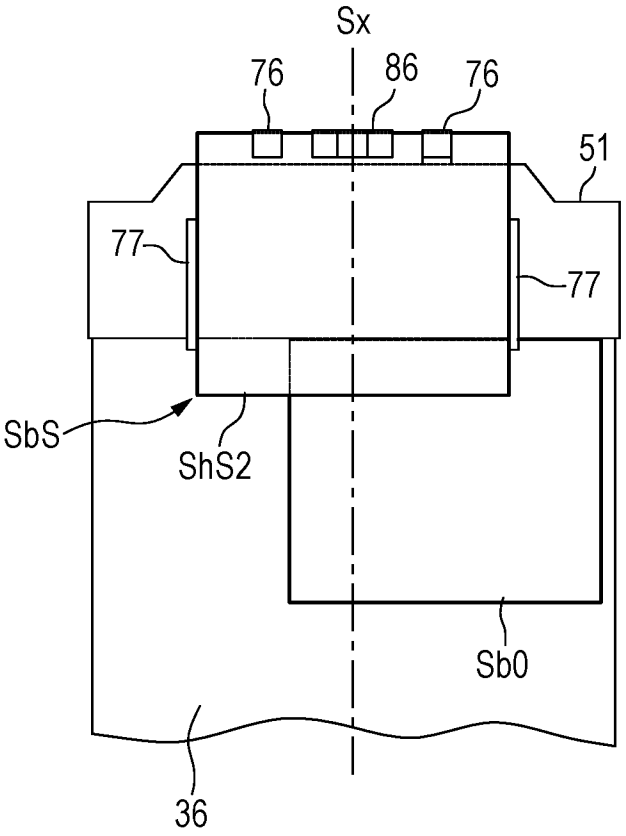

The above-mentioned processes in FIG. 12C and FIG. 13A are repeated, to thereby form the bundle of sheets SbS including a predetermined number of sheets on the processing tray 51. The predetermined number herein is also not the number of sheets included in the bundle of sheets corresponding to the number of originals. As described above, the predetermined number is the number of sheets of the subdivided bundle of sheets formed by dividing the bundle of sheets.

The formed bundle of sheets SbS can be moved to offset by a predetermined distance in the width direction, that is, a direction perpendicular to the carry-out direction as needed. The offset movement is performed by moving the side alignment members 77 in the width direction as illustrated in FIG. 13B while holding the bundle of sheets SbS from both sides, without returning the side alignment members 77 to the retreated positions.

Figure 14A:
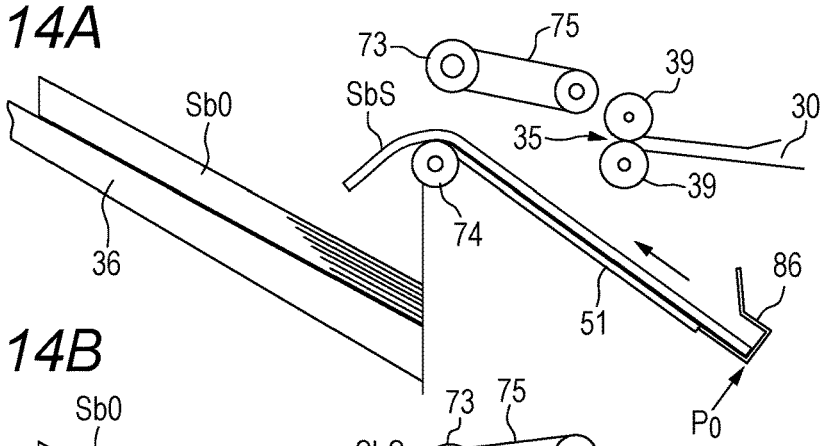
FIGS. 14A, 14B, 14C and 14D are schematic explanatory views for illustrating a process of conveying a bundle of sheets from the processing tray to the stack tray, which are subsequent to FIG. 13B.
Figure 14B:
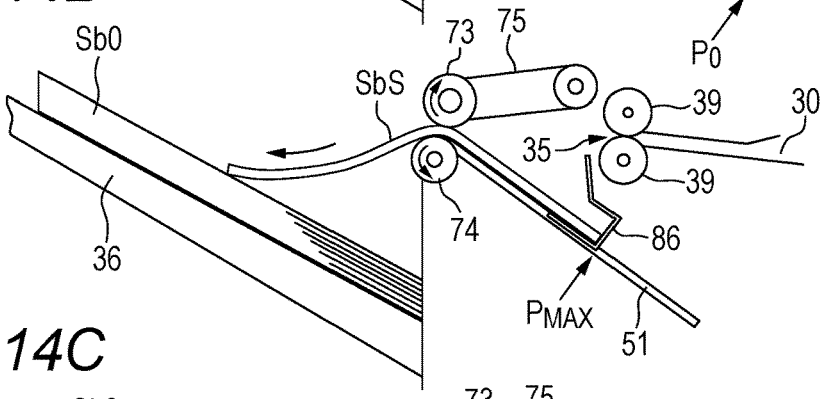

Next, the bundle of sheets SbS having been formed on the processing tray 51 and moved to offset as needed is conveyed to the stack tray 36 by the sheet carry-out mechanism 54. In FIG. 14A, the bundle of sheets SbS is separated from the upper surface of the bundle of sheets Sb0 stacked on the stack tray 36. While the bundle of sheets SbS is held by the side alignment members 77 from both sides as illustrated in FIG. 13B, the conveyor device 81 is operated, and the sheet push-out member 86 is driven to move from the initial position $P_0$ of FIG. 14A to the maximum push-out position $P_{MAX}$ of FIG. 14B, to thereby convey the bundle of sheets SbS in the carry-out direction. In FIG. 14B, the bundle of sheets SbS touches the upper surface of the bundle of sheets Sb0, which has previously stacked on the stack tray 36, with the surface of the downstream end of the bundle of sheets SbS in the carry-out direction.

Figure 14C:
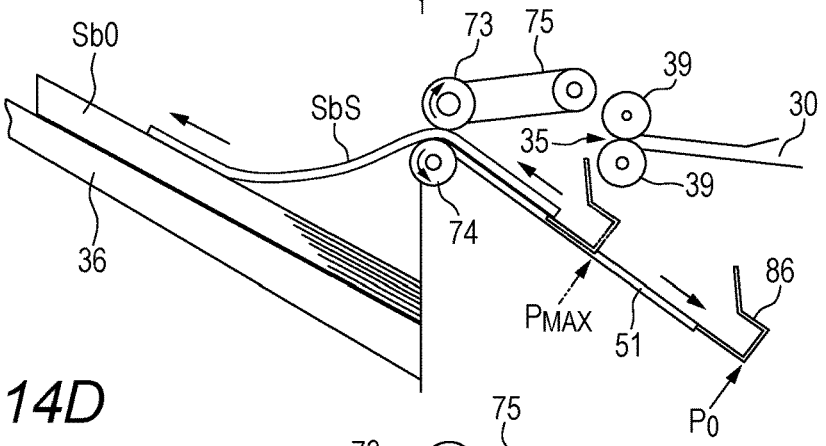
Figure 14D:
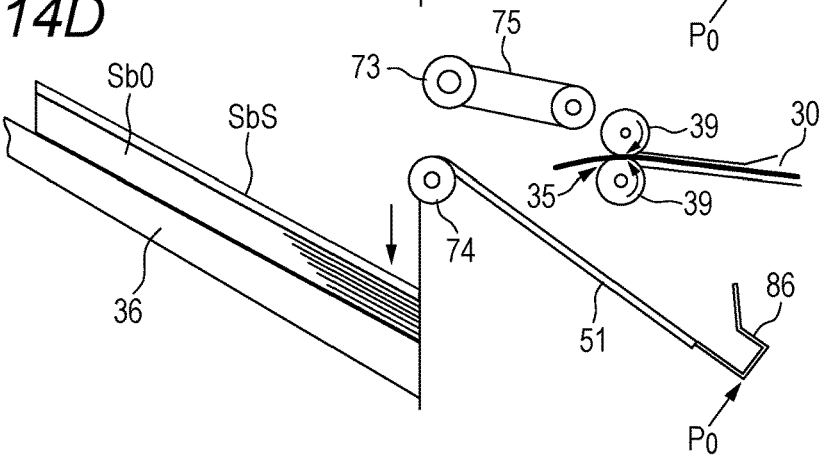

After the sheet push-out member 86 is stopped at the maximum push-out position $P_{MAX}$, as illustrated in FIG. 14B, the upper conveyance roller 73 is moved downward to come into contact with the upper surface of the bundle of sheets SbS, to thereby sandwich the bundle of sheets SbS with the lower conveyance roller 74. As illustrated in FIG. 14C, the upper conveyance roller 73 is driven to rotate in the clockwise direction, and the lower conveyance roller 74 is driven to rotate in the counterclockwise direction, to thereby convey the bundle of sheets SbS in the carry-out direction. The sheet push-out member 86 is returned to the initial position $P_0$ after being stopped at the maximum push-out position $P_{MAX}$. As illustrated in FIG. 14D, the bundle of sheets SbS is conveyed onto the stack tray 36 by the upper and lower conveyance rollers 73 and 74.

In the second mode, the bundle of sheets SbS formed of small size sheets, in a state in which the trailing edge thereof in the carry-out direction is held in contact with the sheet edge regulating members 76, has the downstream end portion in the carry-out direction being separated from the upper surface of the bundle of sheets Sb0 on the stack tray 36 as described above. Therefore, when the bundle of sheets SbS is conveyed from the above-mentioned state to the stack tray 36, the leading edge on the downstream is brought into abutment against the upper surface of the uppermost sheet of the bundle of sheets Sb0 on the stack tray 36.

The bundle of sheets SbS in the second mode has the number of sheets smaller than the number of sheets of the bundle of sheets SbL during the first mode. Thus, even when the leading edge of the bundle of sheets SbS is brought into abutment against the upper surface of the uppermost sheet on the stack tray 36, the impact is smaller than the case of the bundle of sheets having the number of sheets larger than the number of sheets of the bundle of sheets SbL. Further, a significant part of or at least a considerable part of the force of pushing out the bundle of sheets SbS in the carry-out direction by the sheet carry-out mechanism 54 may escape in a direction other than the thickness direction of sheets (direction perpendicular to the sheet surface) from a position of an upper surface of an uppermost sheet of the bundle of sheets Sb0 on the stack tray 36 with which the leading edge of the bundle of sheets SbS is brought into contact due to deformation of the bundle of sheets SbS or slippage of the leading edge of the bundle of sheets SbS caused by having a small number of sheets. Thus, a concern of positional displacement of the sheet on the stack tray 36 may be reduced or eliminated, thereby being capable of improving the sheet stack alignment property.

Also in the case where the bundle of sheets formed of the small size sheets ShSA illustrated in FIG. 15A is conveyed to the stack tray 36, a significant part of or at least a considerable part of the force of pushing out the bundle of sheets in the carry-out direction may similarly escape in a direction other than the thickness direction of the sheets from the position of the upper surface of the uppermost sheet of the bundle of sheets Sb0 on the stack tray 36 with which the leading edge of the small size sheets ShSA is brought into contact due to deformation of the bundle of sheets or slippage of the bundle of sheets at the leading edge. Thus, a concern of positional displacement of the sheet on the stack tray 36 may be reduced or eliminated, thereby being capable of obtaining the effect of improving the sheet stack alignment property.

In the case of the bundle of sheets formed of the small size sheets ShSB illustrated in FIG. 15B, the leading end portion of the bundle of sheets is in surface-contact with the upper surface of the uppermost sheet of the bundle of sheets Sb0 on the stack tray 36, but the contact area is small. Therefore, substantially similarly to the case of FIG. 15A, it can be assumed that the small size sheet ShSB is brought into abutment at the contact end portion thereof against the upper surface of the bundle of sheets Sb0 on the stack tray 36. Also in this case, when the bundle of sheets is conveyed to the stack tray 36, a significant part of or at least a considerable part of the force of pushing out the bundle of sheets in the carry-out direction escapes in the direction other than the thickness direction of the sheets due to deformation of the bundle of sheets or slippage at the contact end portion. Thus, similarly, a fear of positional displacement of the sheet on the stack tray 36 may be reduced or eliminated, thereby being capable of obtaining the effect of improving the sheet stack alignment property.

Further, according to the present invention, as described above, the maximum sheet size (length in the carry-out direction) to be handled by the image forming apparatus A is set to be a large size, and all of sheet sizes (length in the carry-out direction) smaller than the maximum sheet size is set to be a small size. Thus, the second mode may be selected. The small size is set on the safety side, and hence the fear in positional displacement of the sheets on the stack tray 36 caused by the bundle of sheets conveyed from the processing tray 51 is eliminated more securely, thereby being capable of further improving the sheet stack alignment property.

In the embodiments described above, the position of the trailing edge in the carry-out direction of the bundle of sheets stacked on the processing tray 51 is defined by the sheet edge restricting portion, that is, the sheet edge regulating members 76 and the sheet push-out member 86 fixed or arranged on the upstream end of the processing tray 51 in the carry-out direction. According to another embodiment of the present invention, the position of the trailing edge in the carry-out direction of the bundle of sheets on the processing tray 51 can be set or changed to downstream of the upstream end in the carry-out direction.

FIG. 16A to FIG. 16C, FIG. 17A, and FIG. 17B are illustrations of such another embodiment of the present invention. As illustrated in FIG. 16A to FIG. 16C, FIG. 17A, and FIG. 17B, in the embodiment, the sheet push-out member 86 constructing a part of the sheet edge restricting portion moves from the initial position $P_0$ on the upstream end in the carry-out direction and stops at a predetermined downstream position. The predetermined downstream position can be set at any position within the movable range of the sheet push-out member 86 from the initial position $P_0$ to the maximum push-out position $P_{MAX}$ illustrated in FIG. 5, excluding the initial position $P_0$. In the embodiment, the predetermined downstream position is set at the maximum push-out position $P_{MAX}$. Further, the predetermined downstream position is not necessarily fixed at a certain position, and can be changed as needed even during operation of the image forming system 100 by driving the conveyor device 81.

Figure 16A:
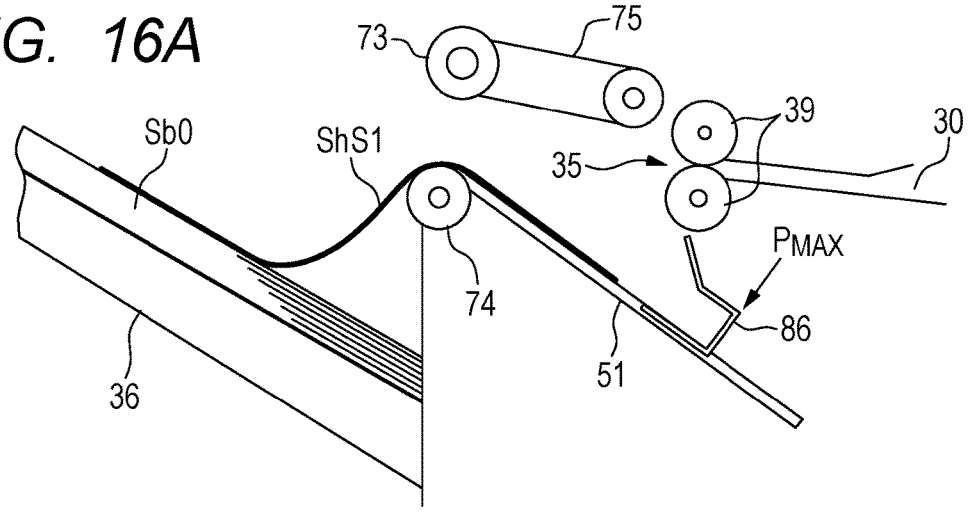
FIGS. 16A, 16B and 16C are schematic explanatory views for illustrating a process of conveying a plurality of sheets to a processing tray according to another embodiment of the present invention.

First, as in the case described above in relation to FIG. 11A, the small size sheet ShS1 is discharged by the discharge roller pair 39 through the sheet discharge port 35 to the processing tray 51, and, as illustrated in FIG. 16A, placed in the state of extending over the processing tray 51 and the stack tray 36. Next, as illustrated in FIG. 16B, the vertically movable bracket 75 is turned downward to bring the upper conveyance roller 73 into contact with the upper surface of the sheet ShS1 on the processing tray 51, and the upper conveyance roller 73 is rotated in the counterclockwise direction, to thereby convey the sheet ShS1 in the carry-in direction.

Figure 16B:
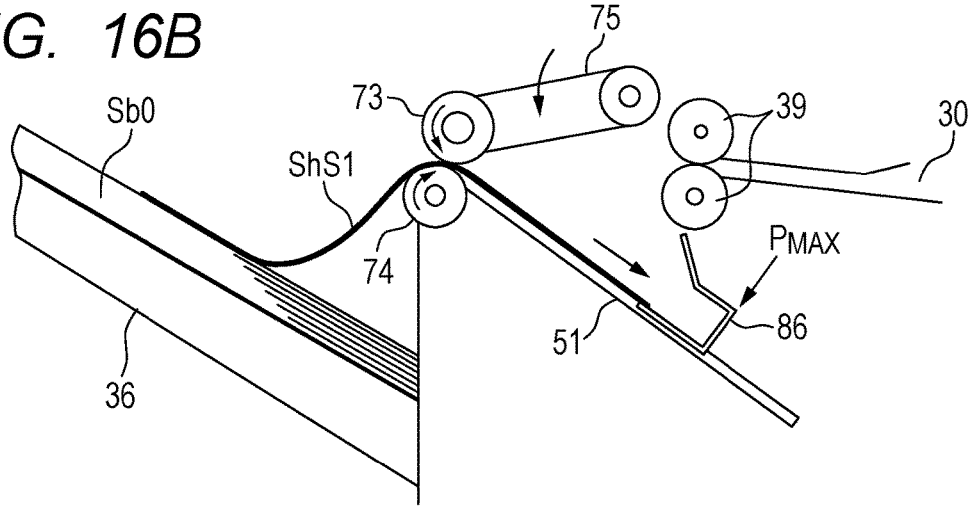
Figure 16C:
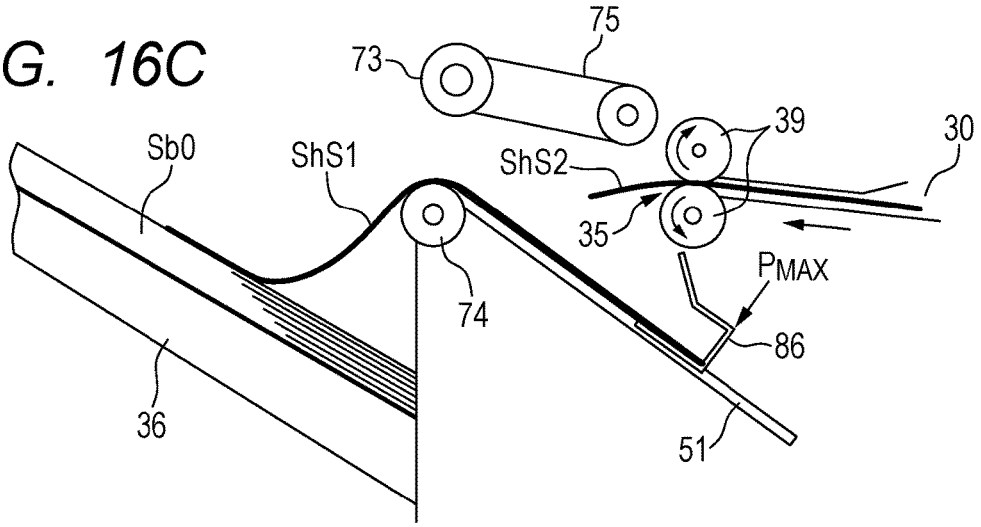

With this, as illustrated in FIG. 16C, the sheet ShS1 is conveyed to a position at which the trailing edge of the sheet ShS1 in the carry-out direction is brought into contact with the sheet push-out member 86. The rotation of the upper conveyance roller 73 is stopped, and the vertically movable bracket 75 is turned upward to return to the original upper position. With the arrangement of the sheet push-out member 86 at the maximum push-out position $P_{MAX}$, as in the case of the large size sheet ShL1 in FIG. 7C, the small size sheet ShS1 has a downstream end portion in the carry-out direction in surface-contact with the upper surface of the bundle of sheets Sb0 on the stack tray 36 over a relatively large area. Thus, the first mode rather than the second mode can be selected.

In the embodiment, the sheet push-out member 86 is arranged at the maximum push-out position $P_{MAX}$, and the raking rotary member 72 is arranged at a position substantially the same as the position illustrated in FIG. 11B as viewed in the drawing sheet direction of FIG. 16A to FIG. 16C. Thus, in FIG. 16B, the sheet ShS1 is conveyed only with the pair of conveyance rollers 73 and 74. When the sheet push-out member 86 is arranged downstream of the maximum push-out position $P_{MAX}$, the sheet ShS1 can be conveyed further with use of the raking rotary member 72.

In the embodiment, as illustrated in FIG. 16C, a ratio of a portion of the sheet ShS1 to be supported over the stack tray 36 with the sheet ShS1 bridging between the processing tray 51 and the stack tray 36 is larger as compared to the portion to be supported on the processing tray 51. Thus, it is preferred that the alignment processing of aligning a sheet in the width direction by the side alignment members 77 described in relation to FIG. 12A to FIG. 12C, FIG. 13A, and FIG. 13B be prevented from being performed. Thus, immediately after the trailing edge of the preceding sheet ShS1 in the carry-out direction is positioned by the sheet push-out member 86, the next sheet ShS2 can be discharged through the sheet discharge port 35 to the processing tray 51.

Figure 17A:
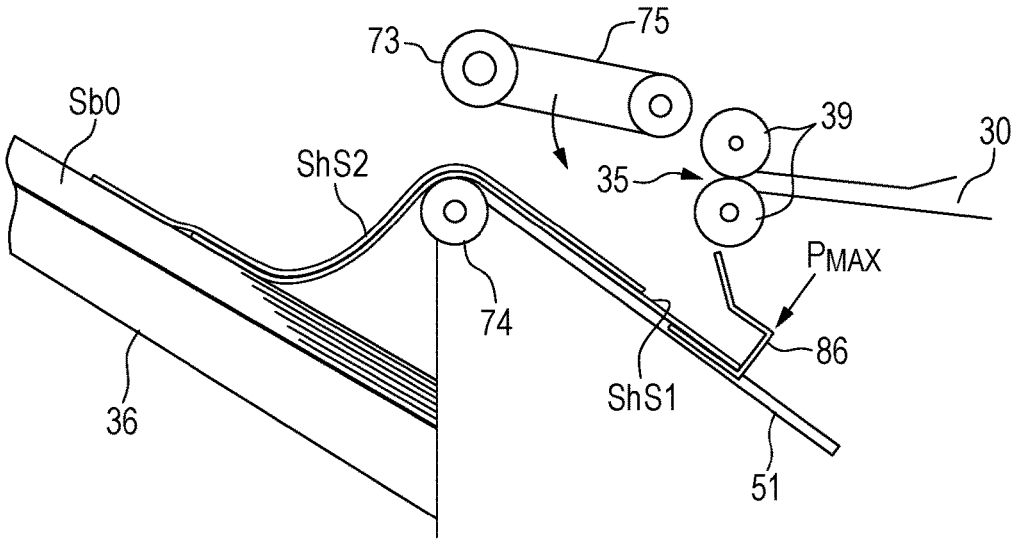
FIGS. 17A and 17B are schematic explanatory views for illustrating a process of conveying and stacking a succeeding sheet on the processing tray, which are subsequent to FIG. 16C.
Figure 17B:
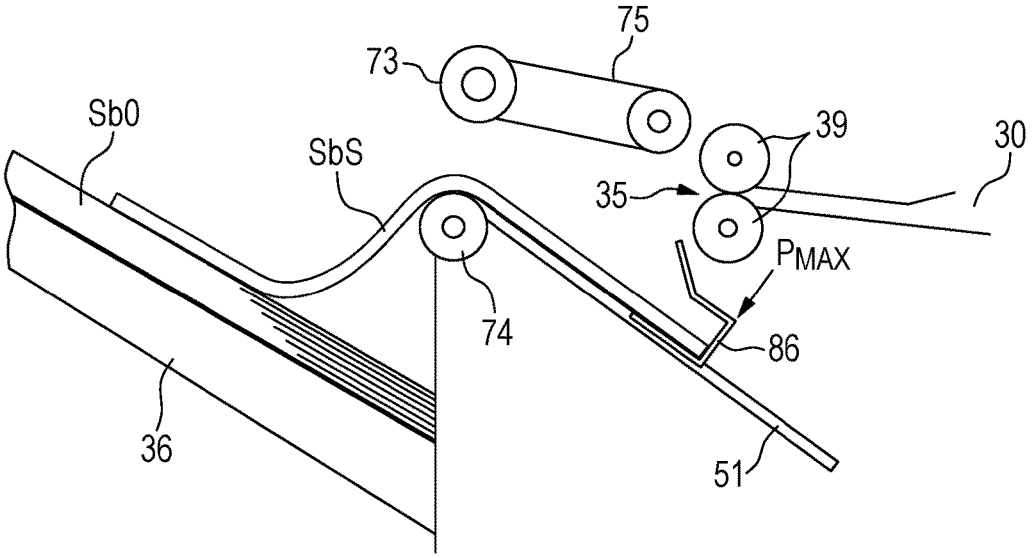

As illustrated in FIG. 17A, the next sheet ShS2 is placed in superposition on the preceding sheet ShS1 in the state of extending over the processing tray 51 and the stack tray 36. As in the case of FIG. 16B, the next sheet ShS2 is conveyed to a position at which the trailing edge of the next sheet ShS2 in the carry-out direction is brought into contact with the sheet push-out member 86 through rotation of the upper conveyance roller 73 in contact with the upper surface of the next sheet ShS2. The series of processes are repeated, to thereby form the bundle of sheets SbS including a predetermined number of sheets on the processing tray 51 as illustrated in FIG. 17B.

As described above, even when the sheet size is the small size, the formation and conveyance of the bundle of sheets SbS on the processing tray 51 can be performed in the first mode. Therefore, even when the alignment processing of aligning the sheet ShS and the bundle of sheets SbS in the width direction on the processing tray 51 is omitted as described above, the bundle of sheets SbS including the number of sheets larger than in the second mode can be formed, thereby improving the productivity. Further, omission of the alignment processing in the width direction enables high speed processing, thereby further improving the productivity.

The selection of the first mode or the second mode can be performed by the post-processing apparatus control portion 88 of the sheet post-processing apparatus B. For example, in a case where a user selects a processing mode focusing on high speed and productivity as to a small size sheet through an operation panel of the image forming apparatus A, the information is transferred in advance to the post-processing apparatus control portion 88. Based on the information, the post-processing apparatus control portion 88 selects the first mode according to the embodiment and causes the sheet push-out member 86 to move in advance to the downstream position suitable for the sheet size, to thereby perform the series of processing described above.

In the embodiments described above, the post-processing apparatus control portion 88 of the sheet post-processing apparatus B selects whether the formation and conveyance of the bundle of sheets is to be performed in the first mode or the second mode. In another embodiment, the selection of the first mode or the second mode can be performed by the main body control portion 87 of the image forming apparatus A, and the selection may be specified with respect to the post-processing apparatus control portion 88. Further, according to another embodiment, the sheet stacking apparatus 37 itself may have a control function of selecting the first mode or the second mode.

The sheet stacking apparatus 37 of the embodiment is configured so that the sheet carry-in mechanism 52 is operable in the first mode of forming the bundle of sheets SbL including the sheet ShL in the state in which the sheet ShL is supported by the processing tray 51 and the stack tray 36. Further, the sheet carry-in mechanism 52 is operable in the second mode of forming the bundle of sheets SbS while allowing the downstream end portion of the bundle of sheets SbS in the moving direction (carry-out direction) to be positioned on upstream in the moving direction with respect to the downstream end portion in the moving direction of the bundle of sheets SbL formed in the first mode. The number of sheets in the bundle of sheets SbS formed by the sheet stacking apparatus 37 in the second mode is smaller than the number of sheets in the bundle of sheets SbL formed by the sheet stacking apparatus 37 in the first mode. Thus, even when the leading edge of the bundle of sheets SbS is brought into abutment against the sheet on the stack tray 36 during the second mode, a fear of displacement of sheets in the bundle of sheets Sb0 on the stack tray 36 due to the impact is reduced or eliminated, thereby being capable of improving the sheet stack alignment property.

In the above-mentioned embodiments, there is illustrated the configuration in which the large size sheet ShL on the processing tray 51 has the downstream end portion in the carry-out direction in contact with the upper surface of the bundle of sheets Sb0 on the stack tray 36 in the state in which the trailing edge of the sheet in the carry-out direction is held in contact with the sheet edge regulating members 76. However, the present invention is not limited to the configuration. The post-processing apparatus control portion 88 may control the sheet post-processing B as follows.

For example, in a configuration of forming bundles of sheets of a plurality of sizes (bundle of large size sheets SbL and bundle of small size sheets SbS) only on the processing tray 51, the number of sheets for forming the bundle of small size sheets SbS (maximum number of sheets constituting the bundle of sheets SbS) may be set smaller than the number of sheets for forming the bundle of large size sheets SbL (maximum number of sheets constituting the bundle of sheets SbL).

When the bundle of sheets Sb formed on the processing tray 51 is conveyed by the sheet push-out member 86 to the stack tray 36, the bundle of large size sheets SbL has a long distance from the sheet push-out member 86 to the leading edge of the bundle of sheets, and the bundle of small size sheets SbS has a shorter distance from the sheet push-out member 86 to the leading edge of the bundle of sheets as compared to that of the large size sheets. Thus, it is conceivable that, when the sheets made of the same material are used, the bundle of small size sheets SbS has a larger stiffness (rigidity) as compared to the bundle of large size sheets SbL.

In view of the above, the bundle of large size sheets SbL is more likely to cause a force to escape when the bundle of sheets is moved by the sheet push-out member 86 to allow the leading edge of the bundle of sheets to be brought into contact with the upper surface of the bundle of sheets Sb0 on the stack tray 36. In contrast, the bundle of small size sheets SbS is less likely to cause a force to escape as compared to the bundle of large size sheets SbL when the leading edge of the bundle of sheets is brought into contact with the upper surface of the bundle of sheets Sb0 on the stack tray 36.

Therefore, in the configuration of forming bundles of sheets of a plurality of sizes only on the processing tray 51, the post-processing apparatus control portion 88 may execute control of setting the number of sheets for forming the bundle of sheets SbS with the small size sheets ShS (first sheet) (maximum number of sheets, such as two sheets, constituting the bundle of sheets SbS) to be smaller than the number of sheets for forming the bundle of sheets SbL with the large size sheets ShL (second sheet) (maximum number of sheets, such as three sheets, constituting the bundle of sheets SbL). With this, even when the leading edge of the bundle of small size sheets SbS is brought into abutment against the sheet on the stack tray 36, a fear of displacement in the sheet Sb0 on the stack tray 36 due to the impact is reduced or eliminated, thereby being capable of improving the sheet stack alignment property.

Further, also in the configuration of forming a bundle of sheets only on the processing tray 51, there are a mode of performing binding and a mode of not performing binding, and the above-mentioned control is executed in the mode of not performing binding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-029825, filed Feb. 19, 2016, and Japanese Patent Application No. 2016-217961, filed Nov. 8, 2016, which are hereby incorporated by reference herein in their entirety.

What is claimed is:

1. A sheet stacking apparatus, comprising:

a first sheet placement portion on which a conveyed sheet is to be placed;

a sheet bundle forming portion configured to form, in a state in which the first sheet placement portion supports a sheet, a bundle of sheets including the sheet;

a sheet moving portion configured to move a bundle of sheets formed by the sheet bundle forming portion in a predetermined moving direction;

a second sheet placement portion on which a bundle of sheets moved by the sheet moving portion is to be placed; and a control portion, wherein the control portion is configured to execute:

a first mode in which the control portion causes the sheet bundle forming portion to form, in a state in which a first sheet is supported by the first sheet placement portion and a second sheet placed on the second sheet placement portion, a bundle of sheets including the first sheet; and a second mode in which, in a case where the control portion causes the sheet bundle forming portion to form, in a state in which a sheet is supported by the first sheet placement portion, a bundle of sheets including the sheet, a downstream end portion of the bundle of sheets in the moving direction is positioned upstream of a downstream end portion of a bundle of sheets to be formed in the first mode in the moving direction, and wherein the control portion is configured to set a maximum number of sheets constituting a bundle of sheets which the control portion causes the sheet bundle forming portion to form in the second mode to be smaller than a maximum number of sheets constituting a bundle of sheets which the control portion causes the sheet bundle forming portion to form in the first mode.

2. A sheet stacking apparatus according to claim 1, wherein one of the first mode and the second mode is selected in accordance with a position of a downstream end portion of a sheet, which is supported by the first sheet placement portion, in the moving direction.

3. A sheet stacking apparatus according to claim 1, wherein a dimension of sheets constituting a bundle of sheets formed in the second mode in the moving direction is smaller than a dimension of sheets constituting a bundle of sheets formed in the first mode in the moving direction.

4. A sheet stacking apparatus according to claim 1, further comprising a binding unit configured to bind a bundle of sheets, wherein the control portion is configured to execute:

a third mode in which the control portion causes the binding unit to bind a bundle of sheets; and a fourth mode in which the control portion prevents the binding unit from binding a bundle of sheets, and wherein the control portion is configured to set a maximum number of sheets constituting a bundle of sheets which the control portion causes the sheet bundle forming portion to form in the second mode during the fourth mode to be smaller than a maximum number of sheets constituting a bundle of sheets which the control portion causes the sheet bundle forming portion to form in the first mode during the fourth mode.

5. An image forming system, comprising:

an image forming unit configured to form an image on a sheet; and a sheet stacking apparatus as recited in claim 1, the sheet stacking apparatus being configured to form a plurality of sheets conveyed from the image forming unit into a bundle of sheets.

6. A sheet stacking apparatus, comprising:

a first sheet placement portion on which a conveyed sheet is to be placed;

a sheet bundle forming portion configured to form, in a state in which the first sheet placement portion supports a sheet, a bundle of sheets including the sheet;

a sheet moving portion configured to move a bundle of sheets formed by the sheet bundle forming portion in a predetermined moving direction;

a second sheet placement portion on which a bundle of sheets moved by the sheet moving portion is to be placed; and a control portion configured to set a maximum number of first sheets constituting a bundle of sheets, which the control portion causes the sheet bundle forming portion to form on the first sheet placement portion, to be smaller than a maximum number of second sheets constituting a bundle of sheets, which the control portion causes the sheet bundle forming portion to form on the first sheet placement portion, a dimension of the first sheets in the moving direction being smaller than a dimension of the second sheets in the moving direction.

7. A sheet stacking apparatus according to claim 6, further comprising a binding unit configured to bind a bundle of sheets, wherein the control portion is configured to execute:

a first mode in which the control portion causes the binding unit to bind a bundle of sheets; and a second mode in which the control portion prevents the binding unit from binding a bundle of sheets, and wherein the control portion is configured to set, in the second mode, a maximum number of the first sheets to be smaller than a maximum number of the second sheets.

8. An image forming system, comprising:

an image forming unit configured to form an image on a sheet; and a sheet stacking apparatus as recited in claim 6, the sheet stacking apparatus being configured to form a plurality of sheets conveyed from the image forming unit into a bundle of sheets.

* * * * *